US007200347B2

(12) United States Patent
Yokoi et al.

(10) Patent No.: US 7,200,347 B2
(45) Date of Patent: Apr. 3, 2007

(54) ELECTROPHOTOGRAPHIC IMAGE FORMING APPARATUS, CARTRIDGE AND PROCESS CARTRIDGE

(75) Inventors: Akiyoshi Yokoi, Kanagawa (JP); Hideshi Kawaguchi, Shizuoka (JP); Noriaki Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/407,153

(22) Filed: Apr. 20, 2006

(65) Prior Publication Data

US 2006/0188285 A1 Aug. 24, 2006

Related U.S. Application Data

(62) Division of application No. 10/865,758, filed on Jun. 14, 2004.

(30) Foreign Application Priority Data

Feb. 27, 2004 (JP) ..... 2004-055461
Jun. 3, 2004 (JP) ..... 2004-166155

(51) Int. Cl.
*G03G 15/00* (2006.01)
*G03G 21/18* (2006.01)

(52) U.S. Cl. ..... 399/90; 399/111

(58) Field of Classification Search ..... 399/90, 399/111, 112–114

See application file for complete search history.

(56) References Cited

U.S. PATENT DOCUMENTS 5,642,187 A 6/1997 Nomura et al. ..... 399/111
5,650,841 A 7/1997 Matsuda et al. ..... 399/111

(Continued)

FOREIGN PATENT DOCUMENTS

EP 0 370 818 A2 5/1990

(Continued)

OTHER PUBLICATIONS

Notification for Reason for Refusal, issued Oct. 11, 2006 in Japanese Application No. 2004-166155 and English translation thereof.*

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An electrophotographic image forming apparatus to which a cartridge is detachably mountable for forming an image on a recording medium, having a main body electrical contact member having a main body electrical contact electrically connected to a cartridge electrical contact of the cartridge in order to supply electric power to an electric power supplied member of the cartridge when the cartridge is mounted on the apparatus main body, the main body electrical contact being movable relative to the apparatus main body, and an electrical contact cover member having an exposed portion for exposing the main body electrical contact, and covering the main body electrical contact member, and attached to the main body electrical contact member so that the exposed portion is movable relative to the main body electrical contact member, wherein in operative association with the operation of mounting the cartridge on the apparatus main body, the electrical contact cover member is moved relative to the main body electrical contact member so that the cartridge electrical contact and the main body electrical contact are electrically connected together in the exposed portion.

7 Claims, 15 Drawing Sheets

U.S. PATENT DOCUMENTS

| | | | | |
|---|---|---|---|---|
| 5,678,139 | A | 10/1997 | Nomura et al. | 399/114 |
| 5,697,022 | A | 12/1997 | Matsuda et al. | 399/102 |
| 5,825,472 | A | 10/1998 | Araki et al. | 355/200 |
| 5,953,562 | A | 9/1999 | Kawaguchi et al. | 399/117 |
| 6,201,935 | B1 | 3/2001 | Terada et al. | 399/13 |
| 6,249,660 | B1 | 6/2001 | Matsushita et al. | 399/115 |
| 6,253,036 | B1 | 6/2001 | Karakama et al. | 399/27 |
| 6,311,026 | B1 | 10/2001 | Higeta et al. | 399/13 |
| 6,351,620 | B1 | 2/2002 | Miyabe et al. | 399/111 |
| 6,463,223 | B1 | 10/2002 | Karakama et al. | 399/27 |
| 6,571,070 | B2 | 5/2003 | Oguma et al. | 399/27 |
| 6,587,650 | B2 | 7/2003 | Yokoi et al. | 399/27 |
| 6,704,525 | B2 | 3/2004 | Oguma et al. | 399/27 |
| 6,735,405 | B2 | 5/2004 | Yokoi et al. | 399/109 |
| 6,993,264 | B2 | 1/2006 | Oguma et al. | 399/90 |
| 2002/0172521 | A1 | 11/2002 | Oguma et al. | 399/27 |
| 2003/0108355 | A1 | 6/2003 | Watanabe et al. | 399/12 |
| 2003/0161644 | A1 | 8/2003 | Yokoi et al. | 399/27 |

FOREIGN PATENT DOCUMENTS

| | | | |
|---|---|---|---|
| JP | 7-77921 | A | 3/1995 |
| JP | 2000-66498 | A | 3/2000 |
| JP | 2004-061595 | * | 2/2004 |

* cited by examiner

ELECTROPHOTOGRAPHIC IMAGE FORMING APPARATUS, CARTRIDGE AND PROCESS CARTRIDGE

CROSS-REFERENCE TO RELATED APPLICATION

This is a divisional application of application Ser. No. 10/865,758, filed Jun. 14, 2004, pending.

BACKGROUND OF THE INVENTION

1. Field of the Invention

The invention relates to an electrophotographic image forming apparatus, a cartridge and a process cartridge.

The electrophotographic image forming apparatus is an apparatus for forming an image on a recording medium (such as recording paper or an OHP sheet) by the use of an electrophotographic image forming process. It includes, for example, an electrophotographic copying machine, an electrophotographic printer, etc.

The cartridge refers to a charging unit, a developing unit and a process cartridge. The charging unit has a charging member for charging an electrophotographic photosensitive member, and is detachably mountable to an electrophotographic image forming apparatus main body. Also, the developing unit has a developing member for developing an electrostatic latent image formed on the electrophotographic photosensitive member, and is detachably mountable to the electrophotographic image forming apparatus main body. Also, the process cartridge refers to at least one of the charging member and the developing member as process means and the electrophotographic photosensitive member integrally made into a cartridge which is made detachably mountable to the electrophotographic image forming apparatus main body.

2. Related Background Art

In an electrophotographic image forming apparatus of a process cartridge type, the mounting and dismounting of the process cartridge with respect to an electrophotographic image forming apparatus main body (hereinafter referred to as the "apparatus main body") can be effected by a user himself without resort to a serviceman. So, the operability of the image forming apparatus could be markedly improved.

In such an electrophotographic image forming apparatus, it is necessary to apply a voltage to a charging member for charging an electrophotographic photosensitive member the process cartridge has, or a developing member or the like for developing an electrostatic latent image formed on the electrophotographic photosensitive member. Also, the giving and receiving of a voltage and a detection signal (output voltage) to and from developer amount detecting means of an electrostatic capacity detecting type or the like the process cartridge has are sometimes effected.

So, when the process cartridge has been mounted to the apparatus main body, it is necessary to effect electrical connection between the process cartridge and the apparatus main body. Therefore, a cartridge electrical contact has heretofore been provided on the frame member of the process cartridge. On the other hand, in the apparatus main body, there is provided a main body electrical contact to be electrically connected to the cartridge electrical contact. Thereby, when the process cartridge has been mounted to the apparatus main body, the cartridge electrical contact and the main body electrical contact are connected together. Thereby, a voltage and a signal are given and received between the apparatus main body and the process cartridge.

Now, during the interchange of the process cartridge or when the jam of a recording medium occurs, an operator performs the operation of dismounting and mounting the process cartridge.

When the process cartridge is detached from the apparatus main body, the main body electrical contact member becomes exposed in the apparatus main body. So, the operator may inadvertently touch the contact member. Thereupon, the fat or the like of his hand may adhere to the contact member, and this has led to the possibility that the reliability of electrical connection is spoiled.

In order to protect such a contact member, there has been proposed a construction in which a protective plate provided in the apparatus main body is moved in operative association with the operation of dismounting and mounting the process cartridge to thereby open and close a contact window (Japanese Patent Application Laid-Open No. 7-77921).

SUMMARY OF THE INVENTION

The present invention is further development of the aforedescribed conventional art.

It is an object of the present invention to provide an electrophotographic image forming apparatus and a cartridge or a process cartridge improved in the reliability of electrical connection between a cartridge electrical contact and a main body electrical contact.

It is another object of the present invention to provide an electrophotographic image forming apparatus in which it is difficult for stains to adhere to a main body electrical contact.

It is still another object of the present invention to provide an electrophotographic image forming apparatus and a cartridge or a process cartridge in which an electrical contact cover member is moved relative to a main body electrical contact member in operative with the operation of mounting a cartridge to an electrophotographic image forming apparatus main body, whereby a cartridge electrical contact and the main body electrical contact are electrically connected together.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An electrophotographic image forming apparatus and a process cartridge according to an embodiment of the present invention will hereinafter be described in greater detail with reference to the drawings.

First Embodiment

{1. General Constructions and Operation of the Electrophotographic Image Forming Apparatus}

Figure 1:
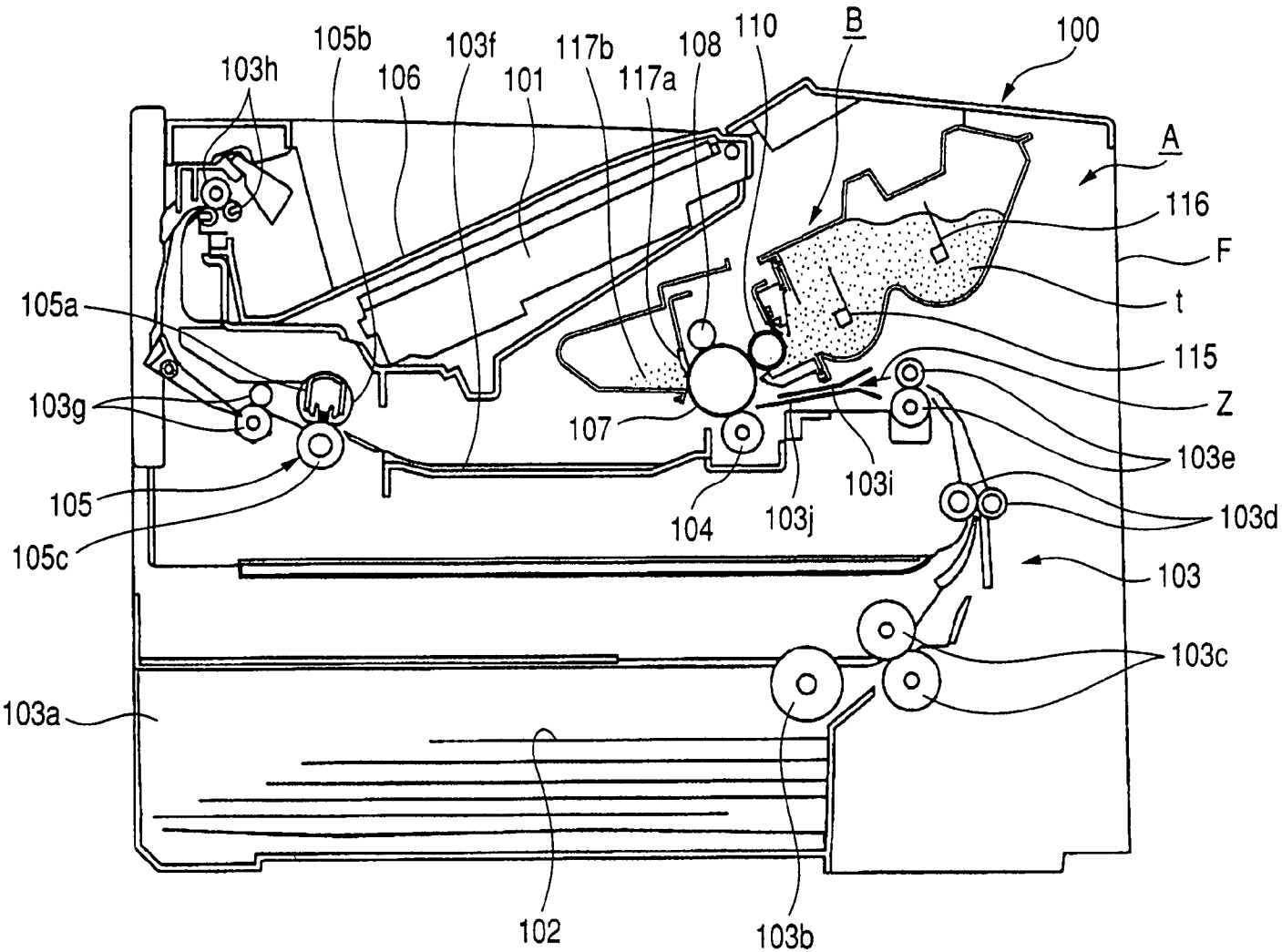
FIG. 1 is a cross-sectional view of an image forming apparatus according to an embodiment of the present invention.

Reference is first had to FIG. 1 to describe the general construction and operation of an electrophotographic image forming apparatus (hereinafter referred to as the "image forming apparatus") 100 to which a process cartridge (hereinafter referred to as the "cartridge") B is detachably mountable. FIG. 1 is a cross-sectional view showing the general construction of the image forming apparatus 100.

Description will hereinafter be made with a laser beam printer taken as an example of the image forming apparatus 100. The image forming apparatus 100 forms an image on a recording medium (e.g. recording paper, an OHP sheet or cloth) by the use of an electrophotographic image forming process in accordance with an image information signal transmitted thereto from a personal computer (or a scanner apparatus or the like) connected to an apparatus main body A for communication therewith.

The image forming apparatus 100 has a drum-shaped electrophotographic photosensitive member (hereinafter referred to as the "photosensitive drum") 107. Image forming will hereinafter be described. The surface of the photosensitive drum 107 being rotated is first uniformly charged by a charging roller 108 as a charging member. Then, a laser beam conforming to image information is applied from optical means 101 having a laser diode, a polygon mirror, a lens and a reflecting mirror (all being not shown) to the photosensitive drum 107. Thereby, an electrostatic latent image conforming to the image information is formed on the photosensitive drum 107. A developer is then supplied to this electrostatic latent image by a developing roller 110 as a developing member. As a result, a developer image is formed on the photosensitive drum 107.

On the other hand, in synchronism with the forming of the developer image on the photosensitive drum 107, a recording medium 102 set in a cassette 103*a* is conveyed by a feed roller 103*b* and pairs of conveying rollers 103*c*, 103*d* and 103*e*. The recording medium 102 is further fed to a transferring position in a conveying direction indicated by arrow Z along an upper transfer guide 103*i* and a lower transfer guide 103*j*. The upper transfer guide 103*i* and the lower transfer guide 103*j* together constitute a conveying guide for guiding the conveying direction of the recording medium 102. At the transferring position, a transfer roller 104 as transferring means is disposed in opposed relationship with the photosensitive drum 107. A voltage is applied to this transfer roller 104, whereby the developer image on the photosensitive drum 107 is transferred to the recording medium 102.

The recording medium 102 to which the developer image has been transferred is conveyed to fixing means 105 through an ante-fixing guide 103*f*. The fixing means 105 is provided with a drive roller 105*c* and a fixing roller 105*b* containing a heater 105*a* therein. It applies heat and pressure to the passing recording medium 102 to thereby fix the developer image on the recording medium 102. Thereafter, the recording medium 102 is conveyed by pairs of rollers 103*g* and 103*h*, and is discharged onto a tray 106.

The feed roller 103*b*, the pairs of rollers 103*c*, 103*d*, 103*e*, the upper transfer guide 103*i*, the lower transfer guide 103*j*, the ante-fixing guide 103*f*, the pairs of rollers 103*g*, 103*h*, etc. together constitute conveying means 103 for conveying the recording medium 102.

{2. Cartridge}

Figure 2:
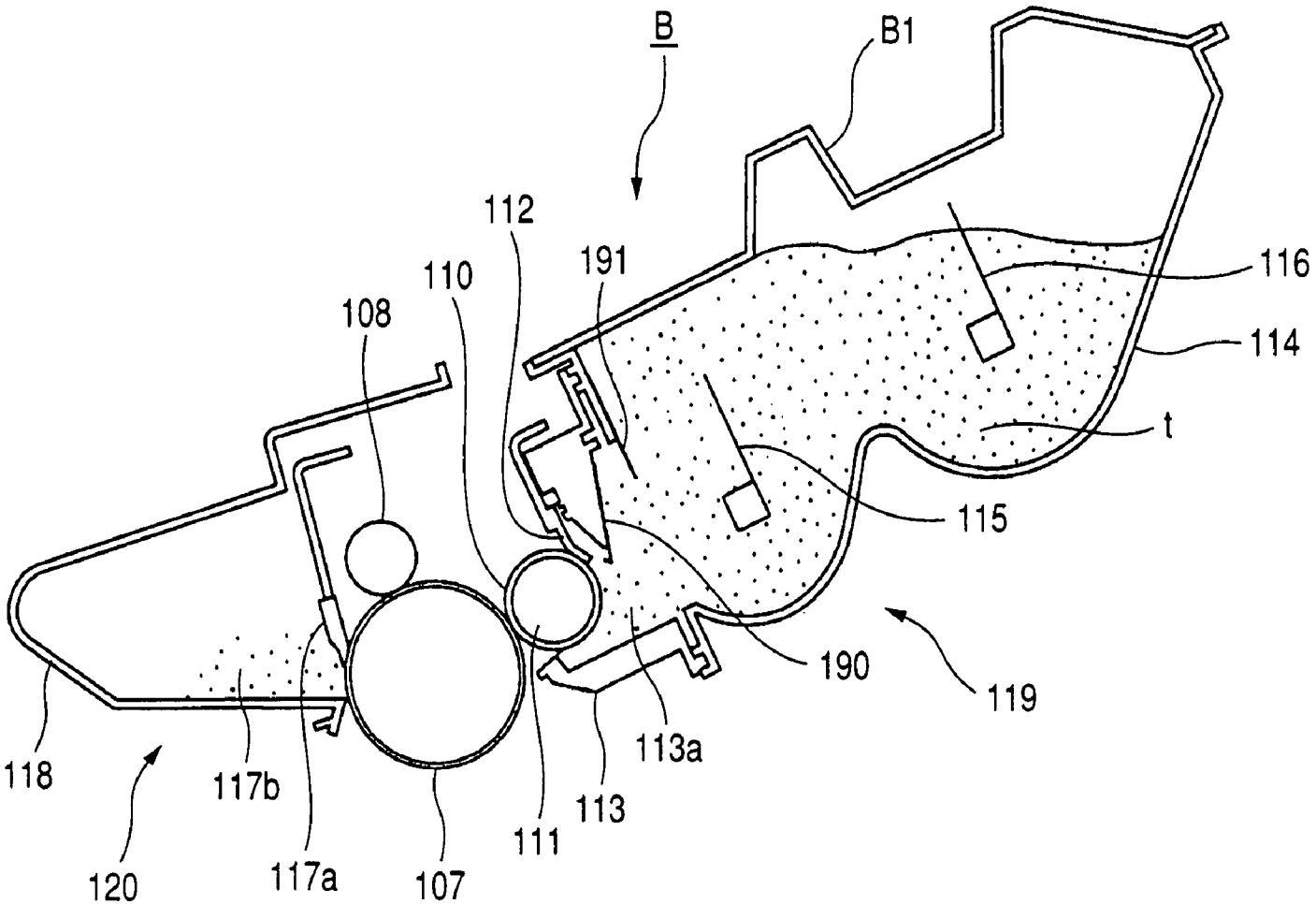
FIG. 2 is a cross-sectional view of a process cartridge according to an embodiment of the present invention.

Reference is now had also to FIG. 2 to describe the cartridge B. FIG. 2 is a cross-sectional view of the cartridge B.

The cartridge B has the photosensitive drum 107. When as shown in FIG. 1, the cartridge B has been mounted on the apparatus main body A, the photosensitive drum 107 receives a driving force from the apparatus main body A and is rotated thereby.

The charging roller 108 as a charging member is provided in opposed relationship with the outer peripheral surface of the photosensitive drum 107. The charging roller 108 has a voltage (charging bias) applied thereto from the apparatus main body A. The charging roller 108 then charges the photosensitive drum 107. The charging roller 108 is provided in contact with the photosensitive drum 107. The charging roller 108 is driven to rotate by the photosensitive drum 107. When the cartridge B has been mounted on the apparatus main body A, the charging roller 108 receives a voltage from the apparatus main body A through a charging output electrical contact 144*a* (see FIG. 6) as a main body electrical contact, and a charging input electrical contact (charging bias contact) 141*a* (see FIG. 8) as a cartridge electrical contact. The charging output electrical contact 144*a* is an electrical contact the apparatus main body A has. Also, the charging input electrical contact (charging bias contact) 141*a* is an electrical contact the cartridge B has. The photosensitive drum 107 is charged by this voltage.

Also, the cartridge B has the developing roller 110 as a developing member. The developing roller 110 supplies a developer "t" to the developing area of the photosensitive drum 107. The developing roller 110 develops the electrostatic latent image formed on the photosensitive drum 107, by the use of this developer "t". The developing roller 110 contains a magnet roller (stationary magnet) 111 therein.

A developing blade 112 as a developer amount regulating member is provided in abutting relationship with the peripheral surface of the developing roller 110. The developing blade 112 regulates the amount of the developer "t" adhering to the peripheral surface of the developing roller 110. Further, the developing blade 112 imparts triboelectric charges to the developer "t".

The developer "t" contained in a developer container 114 is carried into a developing chamber 113*a* by the rotation of agitating members 115 and 116. On the other hand, the developing roller 110 to which a voltage (developing bias) has been applied is being rotated. A layer of developer "t" to which the triboelectric charges have been imparted by the developing blade 112 is formed on the surface of the developing roller 110. The developer "t" formed on the surface of the developing roller 110 moves to the photosensitive drum 107 in conformity with the latent image. Thereby, the latent image is developed.

When the cartridge B has been mounted on the apparatus main body A, the developing roller 110 receives a voltage from the apparatus main body A through a developing output electrical contact 161*a* (see FIG. 6) as a main body electrical contact, and a developing input electrical contact (developing bias contact) 160*a* (see FIG. 8) as a cartridge electrical contact. The developing roller 110 functions by this voltage and develops the electrostatic latent image.

The cartridge B according to the present embodiment is provided with a first detecting electrode 190 and a second detecting electrode 191 as developer amount detecting means capable of detecting the remaining amount of the developer "t" in accordance with the consumption thereof. The first detecting electrode 190 and the second detecting electrode 191 are provided at locations contacting with the developer. Further, the first detecting electrode 190 and the second detecting electrode 191 are disposed at such locations that the areas of contact thereof with the developer fluctuate as the developer "t" is decreased. According to the present embodiment, the first detecting electrode 190 and the second detecting electrode 191 are disposed along the lengthwise direction of the developing roller 110 so as to be opposed to the developing roller 110. In this state, a voltage is applied to one of the first detecting electrode 190 and the second detecting electrode 191. By doing so, capacitance is induced between the two electrodes 190 and 191. The output voltage at this time is measured by the apparatus main body A. Thereby the developer amount is detected.

The cartridge B is provided with a first cartridge remaining amount detecting contact 188*a* and a second cartridge remaining amount detecting contact 189*a* as cartridge electrical contacts.

In the present embodiment, the first cartridge remaining amount detecting contact 188*a* is connected to the first detecting electrode 190. Also, the second cartridge remaining amount detecting contact 189*a* is connected to the second detecting electrode 191.

The developer image formed on the photosensitive drum 107 is transferred to the recording medium 102 by the transfer roller 104. An elastic cleaning blade 117*a* as a cleaning member is disposed in opposed relationship with the outer peripheral surface of the photosensitive drum 107. The tip end of the cleaning blade 117*a* abuts against the photosensitive drum 107. After the developer image has been transferred to the recording medium 102, the cleaning blade 117*a* removes any developer "t" residual on the photosensitive drum 107. The developer "t" removed from the surface of the photosensitive drum 107 by the cleaning blade 117*a* is contained in a removed developer reservoir 117*b*.

The cartridge B is constructed by a developing unit 119 and a drum unit 120 being made integral with each other. The developing unit 119 has a developing frame member 113 which is a portion of a cartridge frame member B1. The developing unit 119 further has the developing roller 110, the developing blade 112, the developing chamber 113*a*, the developer container 114, the agitating members 115, 116, the first detecting electrode 190, the second detecting electrode 191, etc. Also, the drum unit 120 has a drum frame member 118 which is a portion of the cartridge frame member B1. The drum unit 120 further has the photosensitive drum 107, the cleaning blade 117*a*, the removed developer reservoir 117*b* and the charging roller 108.

Also, the developing unit 119 and the drum unit 120 are pivotally coupled together by a pin (not shown). The developing roller 110 is pressed against the photosensitive drum 107 by a resilient member (not shown) provided between the two units 119 and 120.

{3. Mounting and Dismounting of the Cartridge}

Description will now be made of the mounting and dismounting of the cartridge B with respect to the apparatus main body A.

Figure 3:
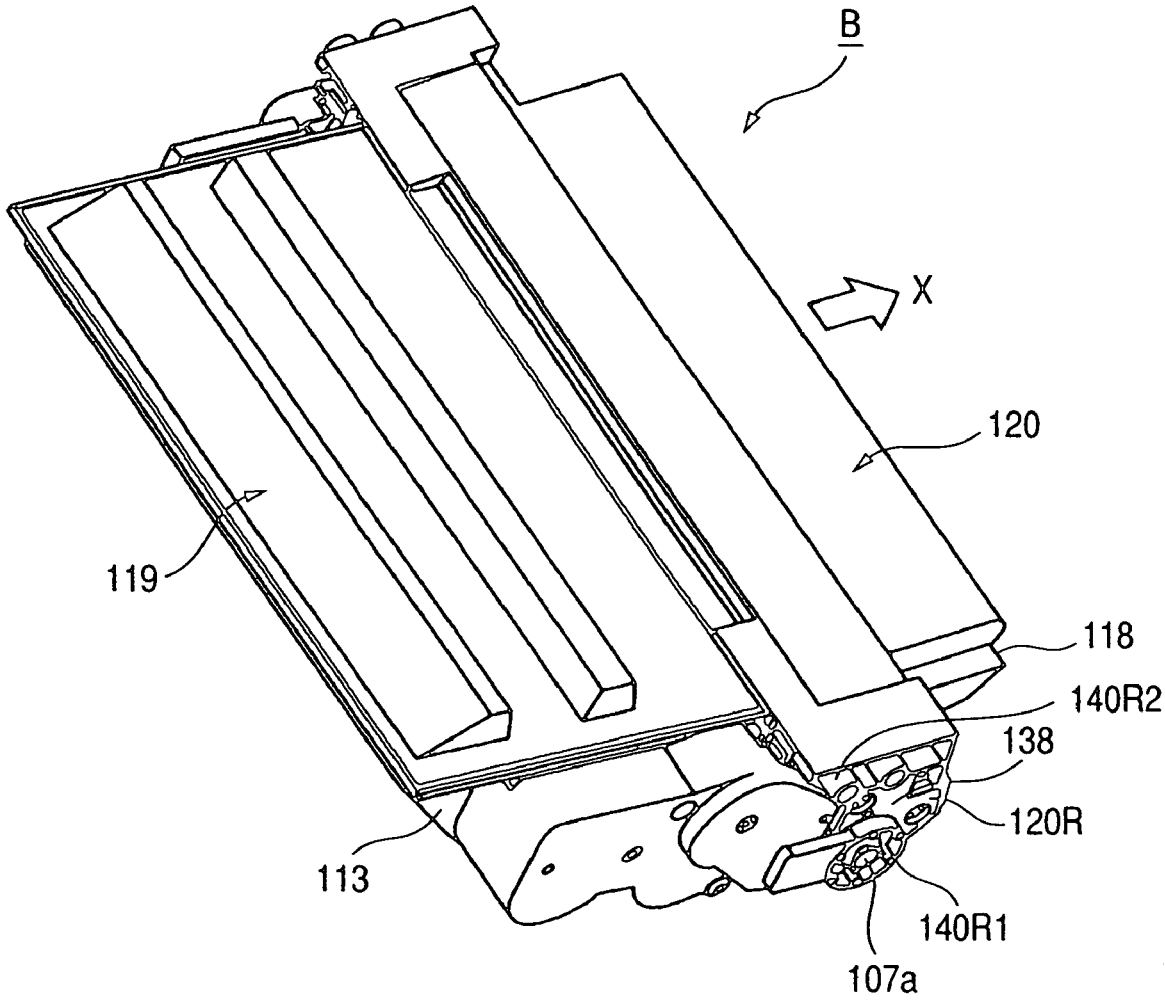
FIG. 3 is a perspective view of a process cartridge according to an embodiment of the present invention.
Figure 4:
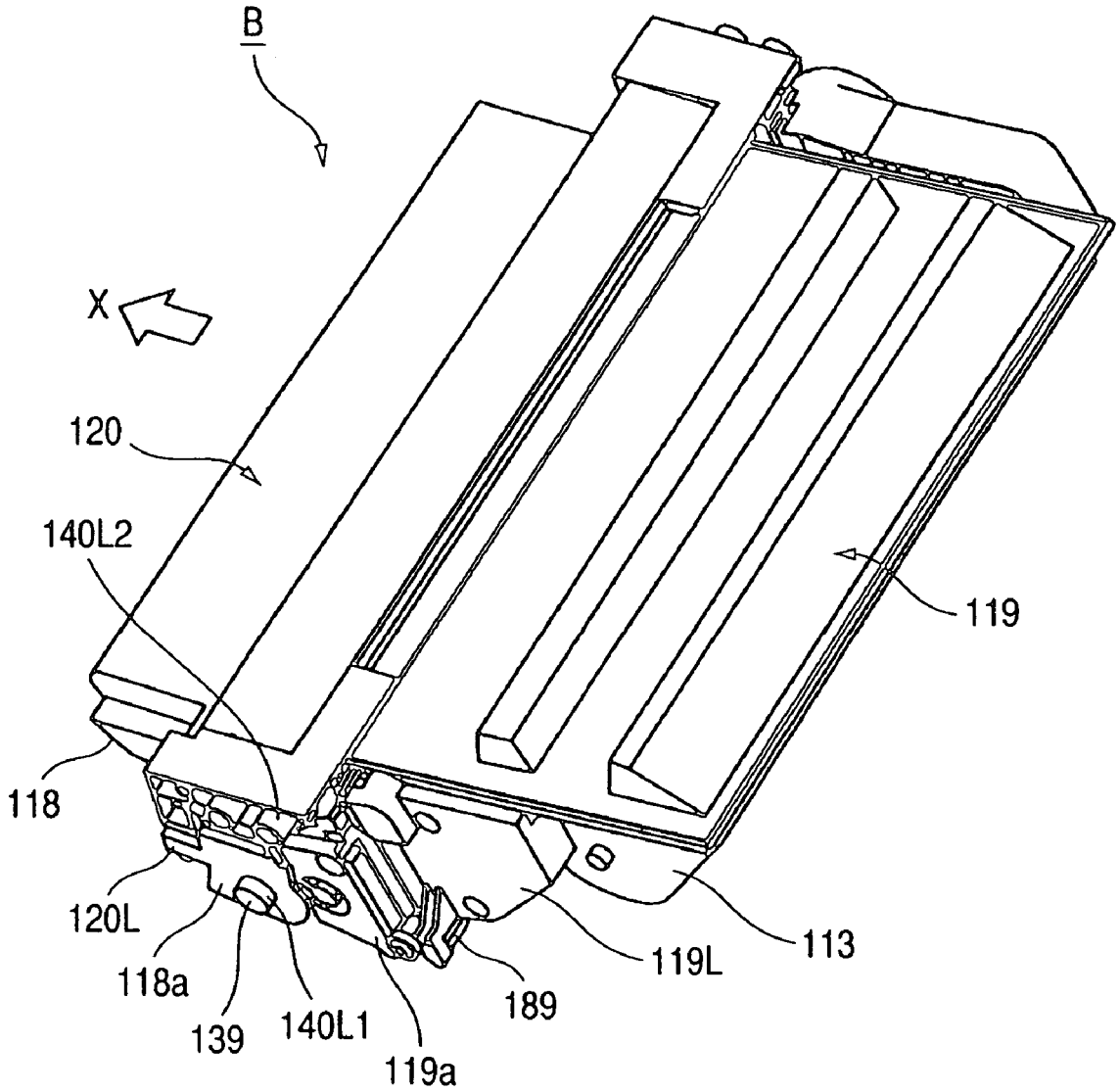
FIG. 4 is a perspective view of a process cartridge according to an embodiment of the present invention.

As shown in FIG. 3, a first right cartridge guide 140R1 and a second right cartridge guide 140R2 as mounting guide members are provided on the lengthwisely one end (the right end as viewed in a direction X in which the cartridge B is mounted) 120R of the drum unit 120. The first right cartridge guide 140R1 is a portion of a drum bearing 138 for supporting one end of the photosensitive drum 107. As shown in FIG. 4, a first left cartridge guide 140L1 and a second left cartridge guide 140L2 as mounting guide members are provided on the lengthwisely other end (the left end as viewed in the direction X in which the cartridge B is mounted) 120L of the drum unit 120. The first left cartridge guide 140L1 is provided on the outer end portion of a drum shaft 139 for supporting the other end of the photosensitive drum 107.

Figure 5:
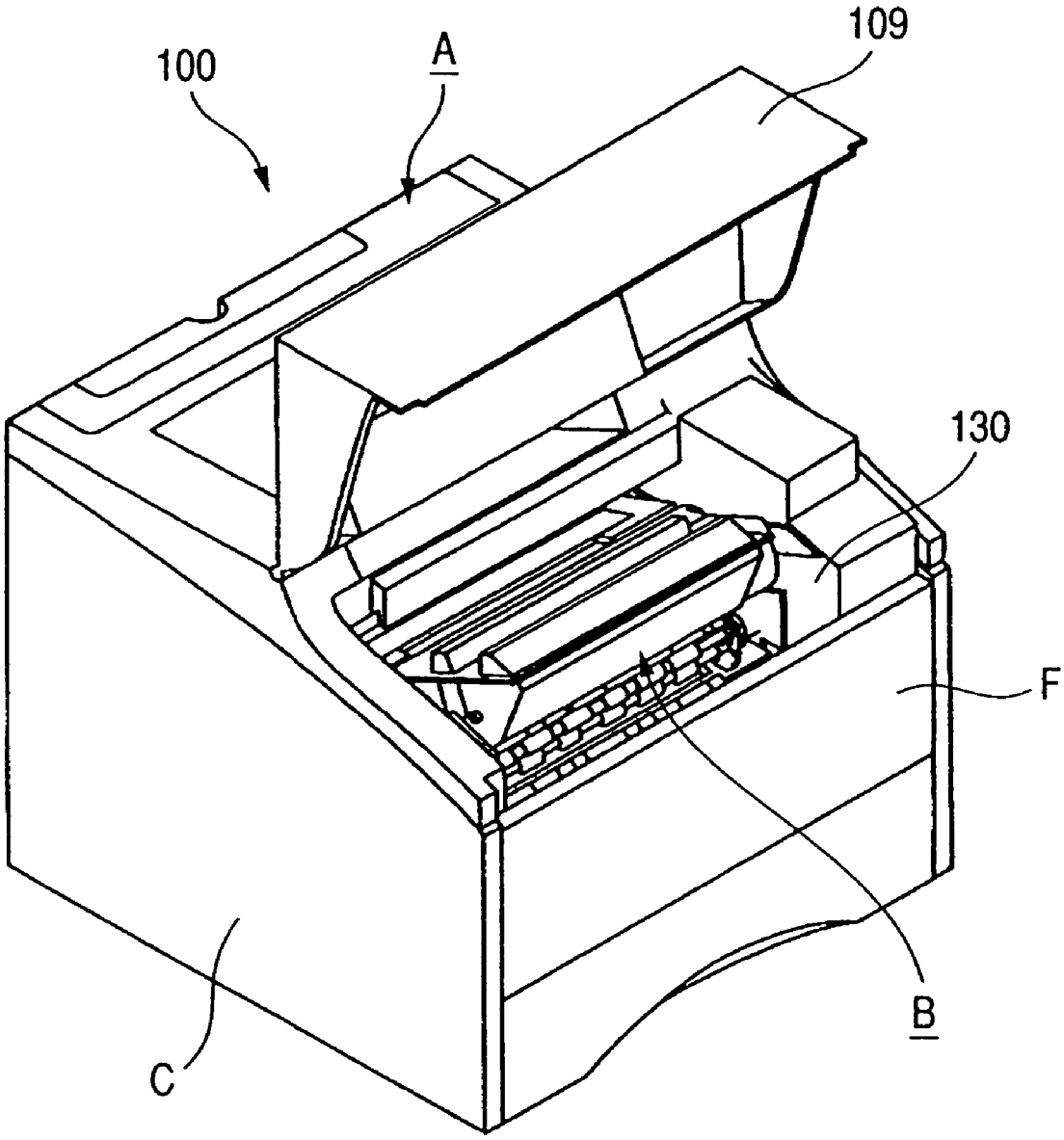
FIG. 5 is a perspective view of an image forming apparatus according to an embodiment of the present invention.

As shown in FIG. 5, when the cartridge B is to be mounted on the apparatus main body A, a door 109 provided on the apparatus main body A is opened by the operator. In the present embodiment, this side of the door 109 with respect to the direction X in which the cartridge B is mounted is upwardly opened. The cartridge B is then detachably mounted with respect to cartridge mounting means 130 provided in the apparatus main body A.

Figure 6:
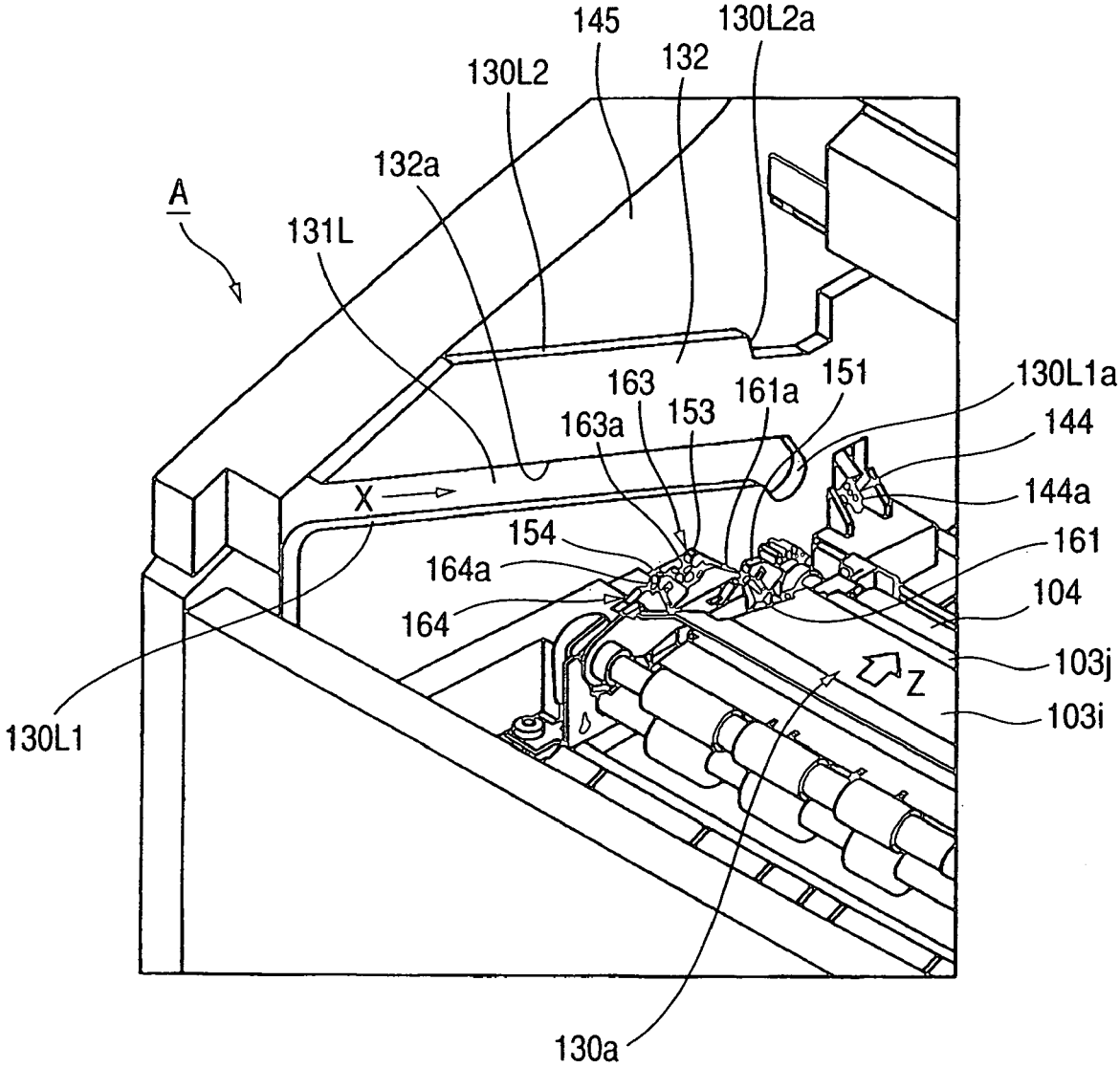
FIG. 6 is a perspective view showing the cartridge mounting portion of an image forming apparatus according to an embodiment of the present invention.
Figure 7:
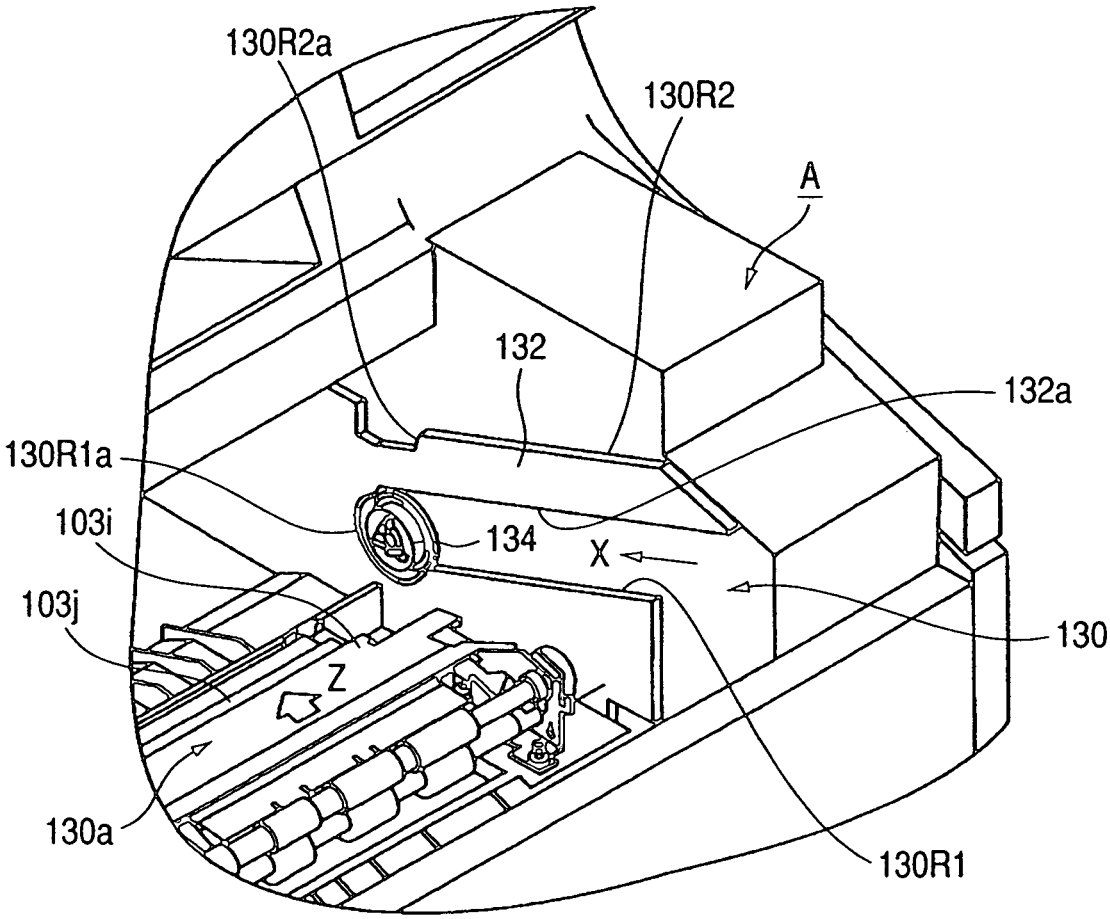
FIG. 7 is a perspective view showing the cartridge mounting portion of an image forming apparatus according to an embodiment of the present invention.

As shown in FIGS. 6 and 7, in the present embodiment, the cartridge mounting means 130 has a first right main body guide 130R1 and a second right main body guide 130R2 in the right half of the apparatus main body A as viewed in the direction X in which the cartridge B is mounted. Also, the cartridge mounting means 130 has a first left main body guide 130L1 and a second left main body guide 130L2 in the left half of the apparatus main body A as viewed in the direction X in which the cartridge B is mounted. When the cartridge B is to be mounted on the apparatus main body A, the first right cartridge guide 140R1 and the second right cartridge guide 140R2 (FIG. 3) are made parallel to the first right main body guide 130R1 and the second right main body guide 130R2, respectively. Also, the first left cartridge guide 140L1 and the second left cartridge guide 140L2 (FIG. 4) are made parallel to the first left main body guide 130L1 and the second left main body guide 130L2, respectively. The cartridge B is then inserted into a cartridge mounting portion 130*a*.

In the present embodiment, the first right main body guide 130R1, the second right main body guide 130R2, the first left main body guide 130L1 and the second left main body guide 130L2 are formed on an inner side plate (frame member) 132 of a predetermined thickness. The inner side plate 132 is fixed to the inner side of the side plate 145 of the apparatus main body A. The inner side plate 132 is cut away into a predetermined shape. An upper end surface forming a level difference relative to the side plate 145 provides the first right main body guide 130R1, the second right main body guide 130R2, the first left main body guide 130L1 and the second left main body guide 130L2. A groove 131L as a main body guide for guiding the cartridge B into the apparatus main body A is formed between the first left main body guide 130L1 and the lower end surface 132*a* of the inner side plate 132 opposed substantially parallel thereto. This groove 131L plays the role as the main body guide for guiding the cartridge B into the apparatus main body A. Likewise, a groove 130R is formed between the first right main body guide 130R1 and the lower end surface 132*a* of the inner side plate B opposed substantially parallel thereto. This groove 130R also plays the role as the main body guide.

The first right cartridge guide 140R1 then fits to the positioning portion 130R1*a* of the first right main body guide 130R1. Further, the second right cartridge guide 140R2 abuts against the positioning portion 130R2*a* of the second right main body guide 130R2. Also, the first left cartridge guide 140L1 fits to the first positioning portion 130L1*a* of the first left main body guide 130L1. Further, the second left cartridge guide 140L2 abuts against the positioning portion 130L2*a* of the second left main body guide 130L2. Thus, the cartridge B is positioned on the apparatus main body A. As described above, the cartridge B is detachably mounted on the cartridge mounting portion 130*a* by the mounting means 130. The cartridge B becomes capable of performing an image forming operation by being mounted on the cartridge mounting portion 130.

The cartridge mounting portion 130*a* is a space occupied by the cartridge B positioned relative to the apparatus main body A by the cartridge mounting means 130. Also, the route along which the space occupied by the cartridge B moves to the cartridge mounting portion 130*a* during the mounting of the cartridge B is the entry route of the cartridge B.

Here, a coupling 134 as a driving force transmitting portion for transmitting drive to the cartridge B is provided in the apparatus main body A. When the cartridge B is to be mounted, the coupling 134 provided in the apparatus main body A is retracted. Accordingly, the coupling 134 does not hinder the mounting of the cartridge B. Also, the coupling 107*a* (FIG. 3) of the cartridge B as a driving force receiving portion for receiving drive from the apparatus main body A is provided in the cartridge B. Incidentally, when the cartridge door 109 is closed, the coupling 107*a* of the cartridge B and the coupling 134 of the apparatus main body A side are connected together. The cartridge B then receives from the apparatus main body A a driving force for rotating the photosensitive drum 107.

{4. Electrical Contacts of the Apparatus Main Body and the Cartridge}

Figure 8:
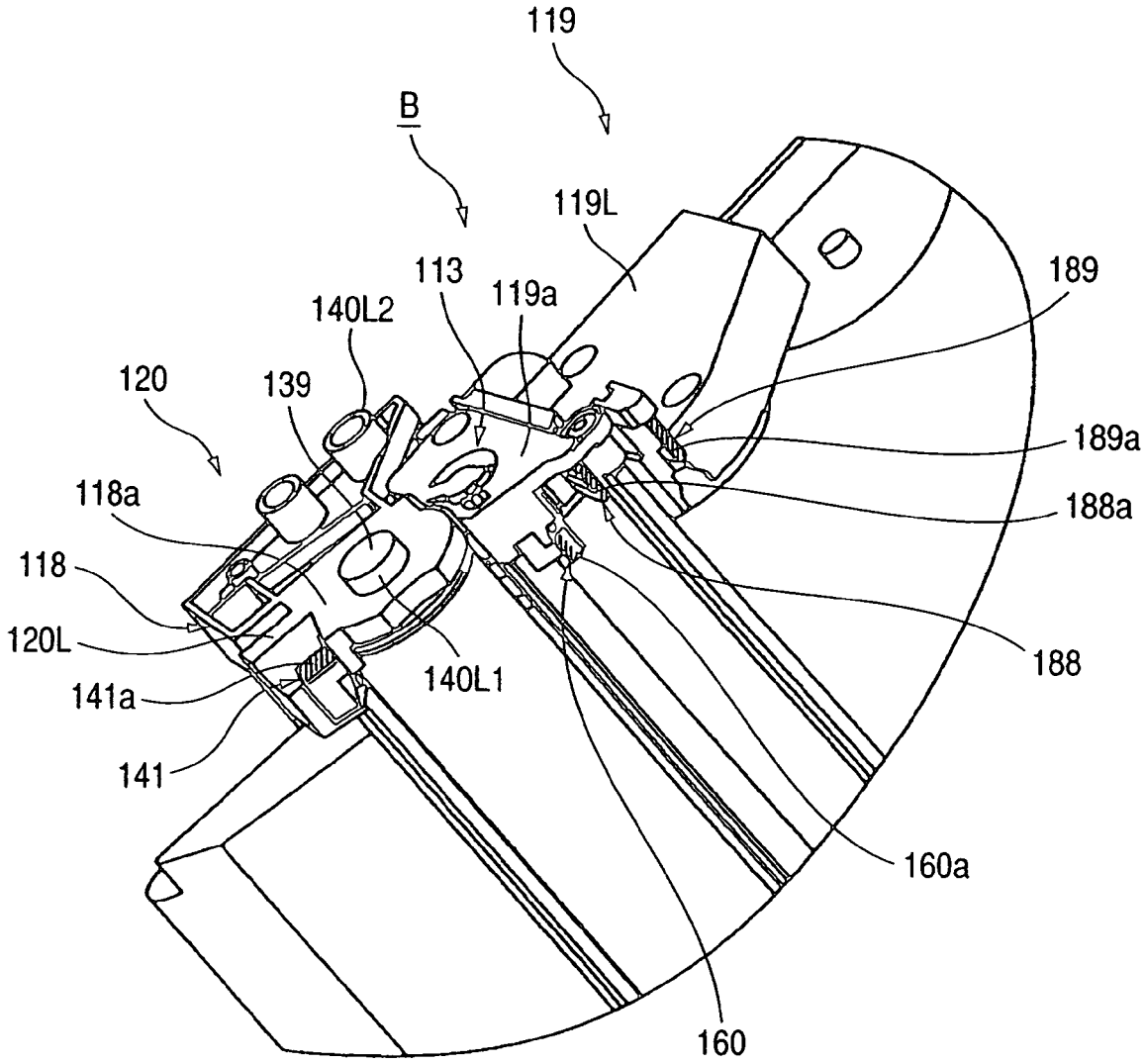
FIG. 8 is a perspective view showing the electrical contact of a process cartridge according to an embodiment of the present invention.

As shown in FIG. 8, the cartridge B has a charging input electrical contact member 141 and a developing input electrical contact member 160 as cartridge electrical contact members. These electrical contact members are for applying a voltage from the apparatus main body A to the charging roller 108 and the developing roller 110. The cartridge B further has a first cartridge remaining amount detecting contact member 188 and a second cartridge remaining amount detecting contact member 189 as cartridge electrical contact members.

In the present embodiment, each of the charging input electrical contact member 141 and the developing input electrical contact member 160 is comprised of a thin metal plate. On the other hand, each of the first cartridge remaining detecting contact member 188 and the second cartridge remaining amount detecting contact member 189 is comprised of a metal bar.

Further, the charging input electrical contact member 141 is provided on the left end portion 120L of the drum unit 120. Also, the charging input electrical contact member 141 is provided so as to be exposed from below and the side of the drum frame member 118 with the cartridge B mounted on the apparatus main body A. The exposed side portion which is apportion of this charging input electrical contact member 141 is a charging input contact 141*a* as a cartridge electrical contact. The charging input contact 141*a* is provided more inside the cartridge B than a drum frame member side 118*a*.

Also, the developing input electrical contact member 160, the first cartridge remaining amount detecting contact member 188 and the second cartridge remaining amount detecting contact member 189 are provided on the left end portion 190L of a developing unit 190. Further, the developing input electrical contact member 160, the first cartridge remaining amount detecting contact member 188 and the second cartridge remaining amount detecting contact member 189 are provided so as to be exposed from below the developing frame member 113 with the cartridge B mounted on the apparatus main body A.

The developing input electrical contact member 160 is worked by bending a thin metal plate at an acute angle. A developing input electrical contact 160*a* as a cartridge electrical contact is constructed on the outer tip end of the bent portion thereof. Also, a first cartridge remaining amount detecting contact 188*a* and a second cartridge remaining amount detecting contact 189*a* are exposed below as respective portions of the first cartridge remaining amount detecting contact member 188 and the second cartridge remaining amount detecting contact member 189. The first cartridge remaining amount detecting contact 188*a* and the second cartridge remaining amount detecting contact 189*a* are provided along the lengthwise direction of the cartridge B (the axial direction of the photosensitive drum 107). The developing input electrical contact 160*a*, the first cartridge remaining amount detecting contact 188*a* and the second cartridge remaining amount detecting contact 189*a* are provided more inside the cartridge B than a developing unit side 119*a*.

The charging input electrical contact 141*a*, the developing input electrical contact 160*a*, the first cartridge remaining amount detecting contact 188*a* and the second cartridge remaining amount detecting contact 189*a* are provided in the named order from downstream to upstream with respect to the direction X in which the cartridge B is mounted. Also, the first cartridge remaining amount detecting contact 188*a*, the second cartridge reaming amount detecting contact 189*a* and the developing input electrical contact 160*a* are provided in the named order from the developing unit side 119*a* to the inside of the cartridge B.

The charging input electrical contact 141*a*, the developing input electrical contact 160*a*, the first cartridge remaining amount detecting contact 188*a* and the second cartridge remaining amount detecting contact 189*a* are electrically connected to the charging roller 108, the developing roller 110, the first detecting electrode 190 and the second detecting electrode 191, respectively, in the interior of the cartridge B.

On the other hand, as shown in FIG. 6, in the apparatus main body A, there are provided a charging output electrical contact member 144 and a developing output electrical contact member 161 as main body electrical contact members for applying a charging voltage and a developing voltage, respectively. When the cartridge B is mounted, the charging output electrical contact member 144 and the developing output electrical contact member 161 are electrically connected to the charging input electrical contact 141*a* and the developing input electrical contact 160*a*, respectively. Also, in the apparatus main body A, there are provided a first main body remaining amount detecting contact member 163 and a second main body remaining amount detecting contact member 164 as main body electrical contact members.

When the cartridge B is mounted, the first main body remaining amount detecting contact member 163 and the second main body remaining amount detecting contact member 164 contact with and are electrically connected to the cartridge remaining amount detecting contacts 188*a* and 189*a*, respectively. Thereby, the apparatus main body A can apply a voltage to one of the first detecting electrode 190 and the second detecting electrode 191. Also, the apparatus main body A can receive a developer amount detection voltage from the other of the first detecting electrode 190 and the second detecting electrode 191.

A charging output electrical contact 144*a*, a developing output electrical contact 161*a*, a first main body remaining amount detecting contact 163*a* and a second main body remaining amount detecting contact 164*a* as main body electrical contacts are provided as respective portions of the main body electrical contact members 144, 161, 163 and 164. These main body electrical contacts 144*a*, 161*a*, 163*a* and 164*a* are provided in the named order from downstream to upstream with respect to the direction X in which the cartridge B is mounted. Also, the first main body remaining amount detecting contact 163*a*, the second main body remaining amount detecting contact 164*a* and the developing output electrical contact 161*a* are provided in the named order from the inner side plate 132 to the inside of the cartridge mounting portion 130*a*.

When the cartridge B is inserted in the direction of arrow X along the aforedescribed cartridge mounting means 130 and is mounted on the apparatus main body A, the main body electrical contacts 144*a*, 161*a*, 163*a* and 164*a* are electrically connected to the cartridge electrical contacts 141*a*, 160*a*, 188*a* and 189*a*, respectively. Thereby, a charging bias is applied through the charging output electrical contact 144*a* and the charging input electrical contact 141*a*. Also, a developing bias is applied through the developing output electrical contact 161*a* and the developing input electrical contact 160*a*. Also, developer remaining amount detection can be effected through the first main body remaining amount detecting contact 163*a*, the second main body remaining amount detecting contact 164*a*, the first cartridge remaining amount detecting contact 188*a* and the second cartridge remaining amount detecting contact 189*a*. Then, the process cartridge becomes capable of operating.

In the present embodiment, the developing output electrical contact 161, the first main body remaining amount detecting contact 163 and the second main body remaining amount detecting contact 164 are disposed in the cartridge mounting portion 130*a* while being covered with electrical contact cover members 151, 153 and 154, respectively.

In the present embodiment, description will be made of a case where the electrical contact cover members 151, 153 and 154 are provided for the developing output contact 161, the first main body remaining amount detecting contact 163 and the second main body remaining amount detecting contact 164, respectively. In the construction of the present embodiment, the developing output electrical contact 161*a*, the first main body remaining amount detecting contact 163*a* and the second main body remaining amount detecting contact 164*a* are on the upstream side with respect to the mounting direction of the cartridge B. On the other hand, the charging output electrical contact 144*a* is on the downstream side with respect to the aforementioned mounting direction. Accordingly, during jam treatment (taking out a jammed recording medium from the apparatus main body when the recording medium is jammed in the apparatus main body) or the like, the operator's hand is liable to have access to the developing output electrical contact 161*a*, the first main body remaining amount detecting contact 163*a* and the second main body remaining amount detecting contact 164*a*. So, the electrical contact cover members 151, 153 and 154 are provided for the developing output contact 161, the first main body remaining amount detecting contact 163 and the second main body remaining amount detecting contact 164, respectively. Of course, a similar construction can also be applied to the charging output electrical contact member 144.

Figure 9:
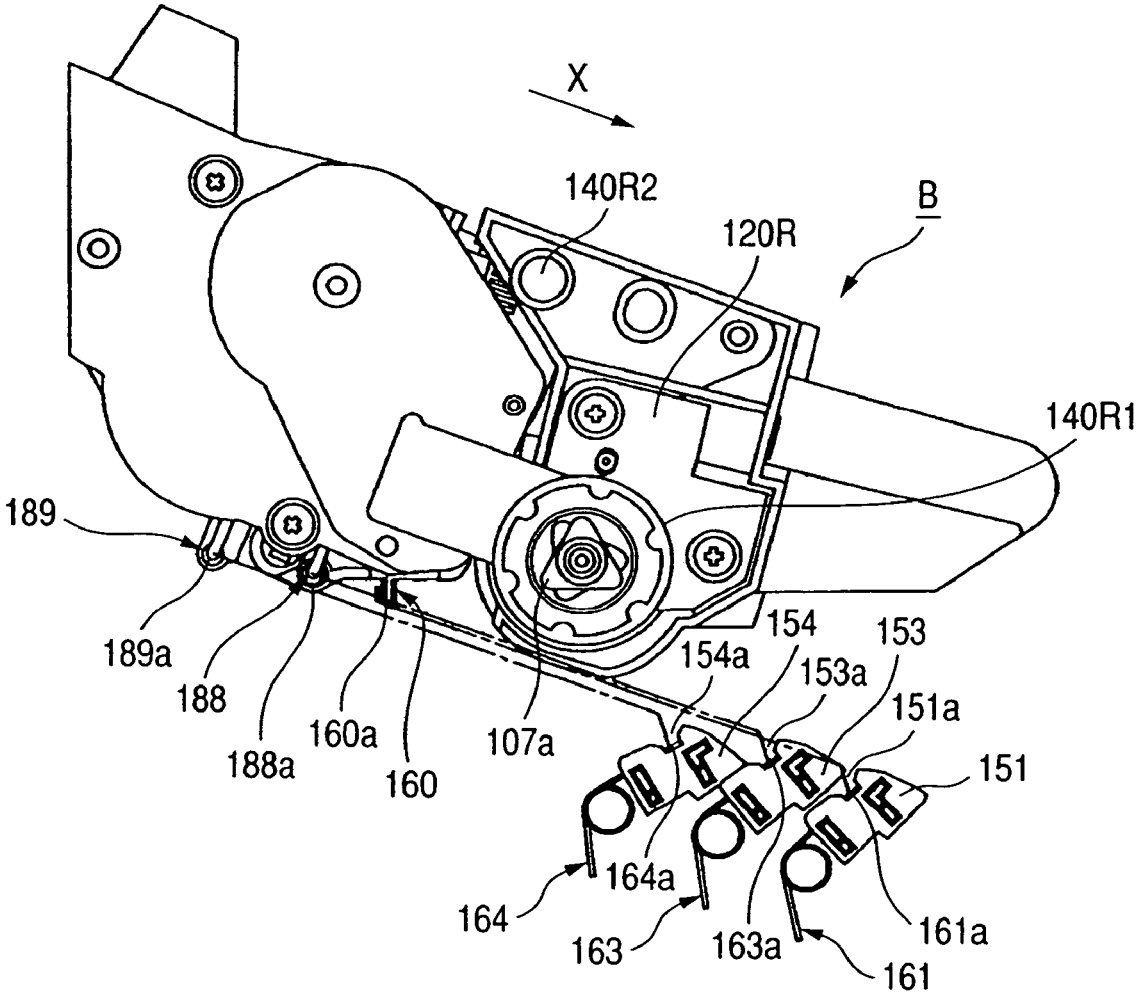
FIG. 9 is an illustration showing the mode of connection between a main body electrical contact in an image forming apparatus according to an embodiment of the present invention and a cartridge electrical contact.

Description will further be made with reference to FIG. 9. FIG. 9 typically shows the mode of connection of the cartridge electrical contacts 160*a*, 188*a* and 189*a* to the main body electrical contacts 161*a*, 163*a* and 164*a*. When the cartridge B is mounted on the apparatus main body A, the respective cartridge electrical contacts 160*a*, 188*a* and 189*a* move as indicated by dot-and-dash lines in FIG. 9. Then, the cartridge electrical contacts 160*a*, 188*a* and 189*a* are electrically connected to the main body electrical contacts 161*a*, 163*a* and 164*a*, respectively. FIG. 9 is a view of the cartridge B and the developing output electrical contact member 161, the first remaining amount detecting contact member 163 and the second remaining amount detecting contact member 164 provided in the apparatus main body A as they are seen from the right side as viewed in the direction in which the cartridge B is mounted.

The cartridge B is inserted in the direction of arrow X along the aforedescribed cartridge mounting means 130 and is mounted on the apparatus main body A. Then, the cartridge electrical contact members 166, 188 and 189 contact with the main body electrical contact members 161, 163 and 164, respectively, with moderate spring pressure.

{5. Construction of the Electrical Contact Cover Members}

Figure 10:
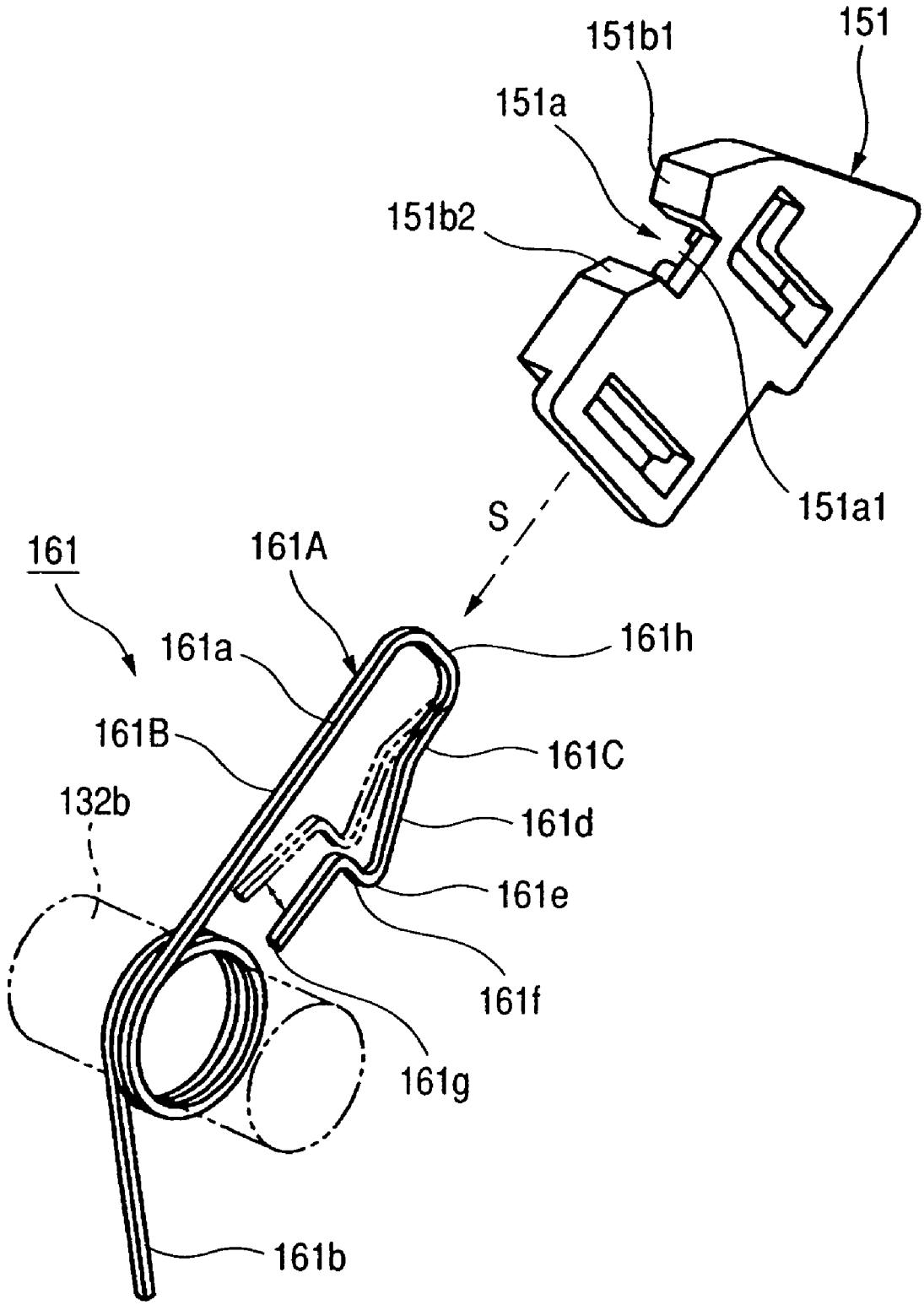
FIG. 10 is a perspective view showing an electrical contact cover member and a main body electrical contact member in an image forming apparatus according to an embodiment of the present invention.
Figure 11A:
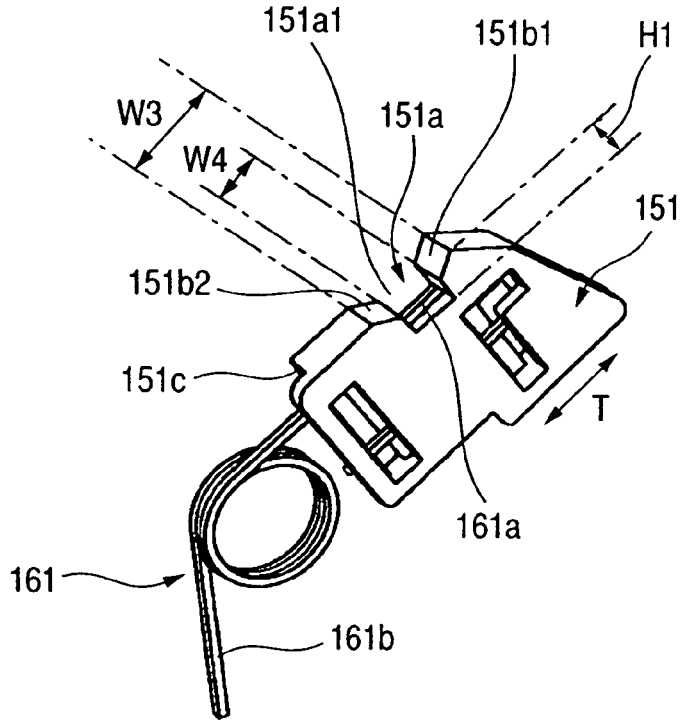
FIGS. 11A and 11B are perspective views showing an electrical contact cover member and a main body electrical contact member in an image forming apparatus according to an embodiment of the present invention.
Figure 11B:
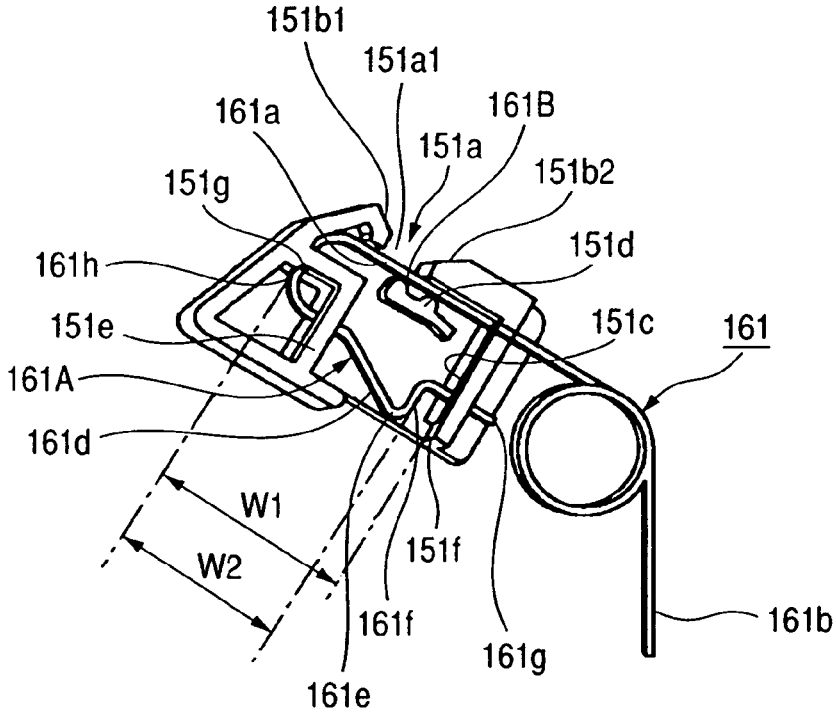

Reference is now had to FIGS. 10, 11A and 11B to describe the electrical contact cover members (hereinafter referred to as the "contact covers") 151, 153 and 154 attached to the developing output electrical contact member 161, the first main body remaining amount detecting contact member 163 and the second main body remaining amount detecting contact member 164, respectively.

In the present embodiment, the developing output electrical contact member 161, the first main body remaining amount detecting contact member 163 and the second main body remaining amount detecting contact member 164 are of the same construction. Also, the contact covers 151, 153 and 154 attached to these respective electrical contacts are substantially of the same construction. Accordingly, description will hereinafter be made of the developing output electrical contact member (hereinafter, in the present embodiment, simply referred to as the "main body contact member") 161 as a representative example, and the contact cover 151 attached thereto.

FIG. 10 shows the main body contact member 161 and the contact cover 151 as they are separated from each other. FIG. 11A shows the right side of the main body contact member 161 with the contact cover 151 attached thereto when it is seen in the direction in which the cartridge B is mounted. FIG. 11B shows the left side of the main body contact member 161 with the contact cover 151 attached thereto when it is seen in the direction in which the cartridge is mounted.

In the present embodiment, the main body contact member 161 is formed by a torsion coil spring which is a resilient member. The main body contact member 161 is mounted on a shaft 132*b* provided in the inner side plate (frame member) 132 of the apparatus main body A. One arm portion of the main body contact member 161 forms a U-shaped portion 161A bent into a substantially U-shape. The other arm portion (base) 161*b* of the main body contact member (torsion coil spring) 161 is connected to an electric circuit (not shown) in the interior of the apparatus main body A.

The developing output electrical contact (hereinafter, in the present embodiment, simply referred to as the "main body contact") 161*a* as a main body electrical contact is provided on the straight portion 161B of the base 161*b* side of the U-shaped portion 161A. By the above-described construction, the main body contact 161*a* as a main body electrical contact is made movable relative to the apparatus main body A.

The main body contact 161*a* contacts with and is electrically connected to the developing input electrical contact (hereinafter, in the present embodiment, simply referred to as the "cartridge contact") 160*a* provided in the cartridge B, with the cartridge B mounted on the apparatus main body A. The cartridge contact 160*a* is the contact of the developing input electrical contact member (hereinafter, in the present embodiment, simply referred to as the "cartridge contact member") 160.

The contact cover 151 is attached to the main body contact member 161 to cover the U-shaped portion 161A of the main body contact member 161. In the present embodiment, the contact cover 151 covers substantially the whole of the U-shaped portion 161A.

That is, as shown in FIG. 10, the contact cover 151 is put on the main body contact member 161 in the direction of arrow S. Thereby, the contact cover 151 is attached to the main body contact member 161. In the present embodiment, owing to the snap-fit shape of the main body contact member 161, the contact cover 151 does not slip out from the main body contact member 161. Further, the contact cover 151 is supported for movement in the direction of arrow T (FIG. 11A) relative to the main body contact member 161. Here, the direction of movement of the main body contact 161*a* relative to the apparatus main body A is V-direction. This V-direction is substantially perpendicular to the direction of arrow T. The material of the contact cover 151 may preferably be a non-electrically conductive one in order to prevent leak.

In the present embodiment, a movable portion 161C is constructed on the end 161*g* side of the U-shaped portion 161A of the main body contact 161. On the movable portion 161C, there is constructed an inclined portion 161*d* widely spaced apart from the straight portion 161B toward the end 161*g*. That portion of this inclined portion 161*d* which is most widely spaced apart from the straight portion 161B is a top 161*e*. A restraining portion 161*f* is provided from the top 161*e* toward the straight portion 161B. The restraining portion 161*f* is substantially perpendicular from the top 161*e* to the straight portion 161B. The end 161*g* is substantially parallel to the straight portion 161B further from this restraining portion 161*f*.

On the other hand, as shown in FIG. 11B, the contact cover 151 is provided with an opening portion 151*c* narrower than the spacing between the top 161*e* and straight portion 161B of the main body contact member 161 in a direction orthogonal to the direction S of attachment to the main body contact member 161. The width of this opening portion 151*c* is substantially the same as the line diameter of the main body contact member (torsion coil spring). Accordingly, the main body contact member 161 is flexed as indicated by dots-and-dash line in FIG. 10 against the resilient force of the U-shaped portion 161A. In that state, the main body contact member 161 is inserted into the opening portion 151*c* of the contact cover 151. When the top 161*e* of the inclined portion 161*d* clears the opening portion 151*c*, the movable portion 161C is restored to its original shape by the resilient force of restitution of the U-shaped portion 161A.

A bumping portion 151*g* for bumping against the tip end 161*h* of the main body contact member 161 is provided inside the contact cover 151. Here, in the direction S of attachment to the main body contact member 161, the width W1 from the bumping portion 151*g* to the edge portion 151*f* of the opening portion 151*c* is greater than the width W2 from the tip end 161*h* to the restraining portion 161*f* in the same direction. Accordingly, with the contact cover 151 attached to the main body contact member 161*f*, the contact cover 151 is movable relative to the main body contact member 161. Also, in this state, the restraining portion 161*f* abuts against the edge portion 151*f*. Therefore, it never happens that the contact cover 151 inadvertently slip out from the main body contact member 161.

Also, a regulating portion 151*d* is provided inside the contact cover 151. The regulating portion 151*d* regulates the position of the straight portion 161B of the U-shaped portion 161A. This regulating portion 151*d* makes the straight portion 161B parallel to the inner side of the contact cover 151. Then, a portion of the straight portion 161B is exposed to the cut-away portion 151*a*. When the contact cover 151 is to be attached to the main body contact member, the tip end 161*h* of the U-shaped portion 161A clears this regulating portion 151*d*.

Further, a side stop 151*e* is provided so that the contact cover 151 may not break away sideways. The side stop 151*e* is provided substantially in parallelism to a plane formed by the U-shaped portion 161A of the main body contact member 161. This side stop 151*e* holds the main body contact member 161 relative to the inner side of the contact cover 151.

In the present embodiment, the contact cover 151 is provided with a cut-away portion (opening portion) 151*a*. The lower end portion of this cut-away portion 151*a* which communicates with the interior of the contact cover 151 is an exposed portion 151*a*1. This exposed portion 151*a*1 exposes the main body contact 161*a* to the outside of the contact cover 151. Thereby, the exposed portion 151*a*1 permits the connection between the cartridge contact 160*a* and the main body contact 161*a*. The cut-away portion 151*a* is formed to a size at which the cartridge contact 160*a* and the main body contact 161*a* can contact with each other. That is, the cut-away portion 151*a* corresponds to the size of the cartridge contact member 160. When the cartridge B is mounted on the apparatus main body A, at least a portion of the cartridge contact member 160 enters this cut-away portion 151*a*. Then, in the exposed portion 151*a*1, the cartridge contact 160*a* contacts with the contact portion (main body contact) 161*a* of the main body contact member 161.

Also, the contact cover 151 is provided with a first guide portion 151*b*1 and a second guide portion 151*b*2 as receiving portions abutting against an abutting portion (in the present embodiment, the cartridge contact member 160) the cartridge B has. In the present embodiment, the first guide portion 151*b*1 and the second guide portion 151*b*2 are provided on the inner side wall of the cut-away portion 151*a*. In other words, the first guide portion 151*b*1 and the second guide portion 151*b*2 are provided on the end portion of the exposed portion 151*a*1. In operative association with the mounting operation of mounting the cartridge B on the apparatus main body A, the abutting portion of the cartridge B first abuts against the first guide portion 151*b*1 and the second guide portion 151*b*2. Next, the first guide portion 151*b*1 and the second guide portion 151*b*2 are pushed by the abutting portion of the cartridge B, whereby the contact cover 151 is moved relative to the main body contact member 161. Accordingly, the exposed portion 151*a*1 is also moved relative to the main body contact member 161. Then, in the exposed portion 151*a*1, the cartridge contact 160*a* and the main body contact 161*a* are electrically connected together. That is, in operative association with the connection of the cartridge B to the apparatus main body A, the cartridge contact 160*a* and the main body contact 161*a* are electrically connected together.

Further describing, with cartridge B mounted on the apparatus main body A, the cut-away portion 151*a* is provided so as to face in a direction in which the cartridge B comes in during the mounting of the cartridge B. Further, the cut-away portion 151*a* is provided so that in the exposed portion 151*a*1, the straight portion 161B of the main body contact member 161 may be exposed. The cut-away portion 151*a* is preferably smaller than the tip end of a finger. Further, the cut-away portion 151*a* is of a shape larger than that portion of the cartridge contact member 160 which comes thereinto.

The first guide portion 151*b*1 and the second guide portion 151*b*2 are the inner sides of the cut-away portion 151*a*. Also, the first guide portion 151*b*1 and the second guide portion 151*b*2 are opposed to each other along the direction S of movement of the contact cover 151. Also, the spacing between the first guide portion 151*b*1 and the second guide portion 151*b*2 in the direction S of movement becomes narrower toward the exposed portion 151*a*1. That is, in the present embodiment, the first guide portion 151*b*1 and the second guide portion 151*b*2, when seen from the mounting direction X of the cartridge B, are constituted by the inner sides of an opening portion continuous to the exposed portion 151*a*1 (i.e., the straight portion 161B of the main body contact member 161 in the interior of the contact cover 151). Therefore, the cartridge contact 160*a* is smoothly directed to the main body contact 161*a*. Further, the width of the opening portion becomes narrower toward the exposed portion 151*a*1 (i.e., the straight portion 161B of the main body contact member 161 in the interior of the contact cover 151). In the present embodiment, the direction of movement of the contact cover 151 (the direction of movement of the contact cover 151 relative to the apparatus main body A) is substantially the same direction as the mounting direction X of the cartridge B.

Although not restricted to this, the width of the upper end of the cut-away portion 151*a* in the direction T of movement of the contact cover 151 relative to the main body electrical contact member 161 (the maximum spacing W3 between the first guide portion 151*b*1 and the second guide portion 151*b*2) is 4 to 8 mm. Also, the width of the lower end portion of the cut-away portion in the same direction (the width W4 of the exposed portion 151*a*1) is 2 to 4 mm. Further, the height H1 from the upper end to the lower end portion of the cut-away portion 151*a* (the exposed portion 151*a*1) is 2 to 3 mm.

In the present embodiment, as shown in FIG. 11B, the main body electrical contact member 161 is exposed from one side of the contact cover 151. Also, however, the inner side plate 132 of the apparatus main body A is located on this side of the contact cover 161. Therefore, the main body electrical contact member 161 is substantially hermetically sealed. However, not only in the present embodiment, this side of the contact cover 151 can be made into a substantially hermetically sealed shape in conformity with the mode of disposition of the contact cover 151 in the apparatus main body A. As shown in FIG. 11A, the other side of the contact cover 151 is substantially hermetically sealed.

Accordingly, even when the operator had access to each contact member of the apparatus main body A during jam treatment or the mounting and dismounting of the cartridge, it is difficult for the operator's fingers to touch the main body contact 161*a* of the main body contact member 161. Further, the size of the cut-away portion 151*a* is smaller than the tip ends of the fingers and larger than the cartridge contact 160*a*. Therefore, it becomes substantially impossible for the operator's fingers to touch the contact portion (main body contact) 161*a* of the cartridge contact member 160.

Thus, it is difficult for a foreign substance (for example, the developer or grease adhering to the operator's hand, or man's sweat or fat) to adhere to the electrical contacts of the apparatus main body A. Therefore, it is difficult for the faulty electrical conduction of the electrical contacts to occur. As a result, it is possible to improve the reliability of the electrical connection between the electrical contacts of the cartridge B and the electrical contacts of the apparatus main body A. For example, it is possible to make it difficult for the injury of the electrical contacts caused by the operator's hand touching them to occur.

Figure 12:
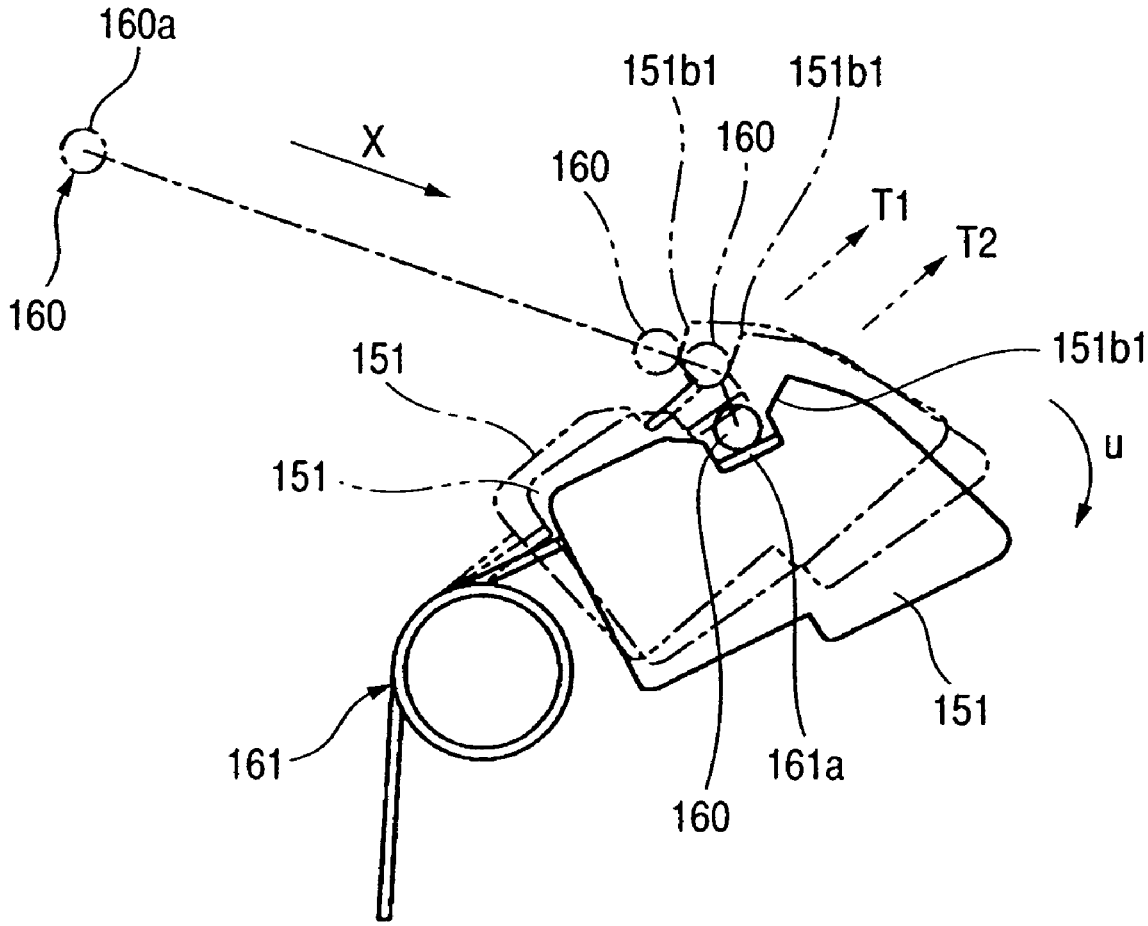
FIG. 12 is a view for illustrating the movable construction of an electrical contact cover member in an image forming apparatus according to an embodiment of the present invention.
Figure 13:
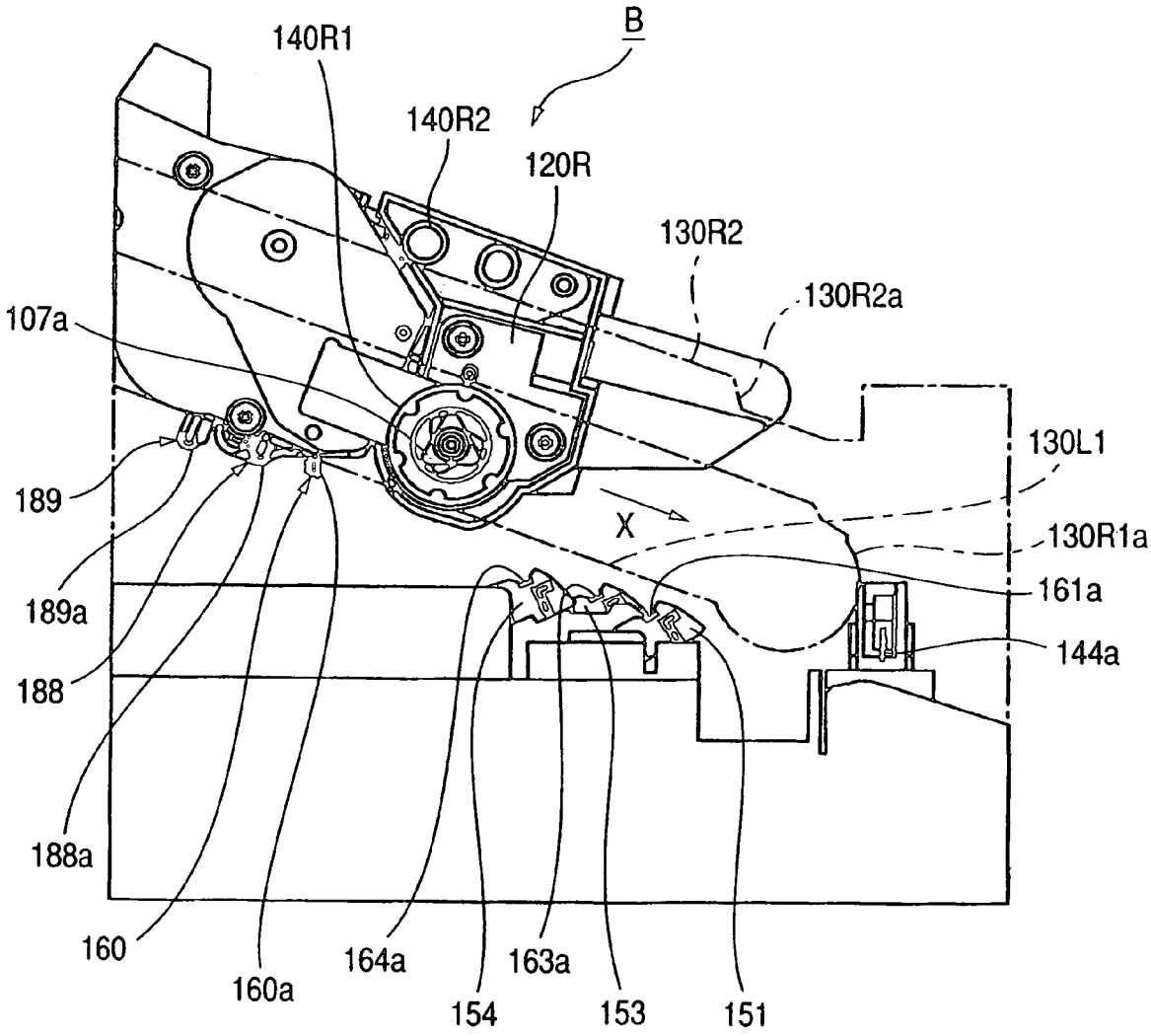
FIG. 13 is a side view of the interior of an apparatus main body for illustrating a process cartridge mounting operation in an image forming apparatus according to an embodiment of the present invention.
Figure 14:
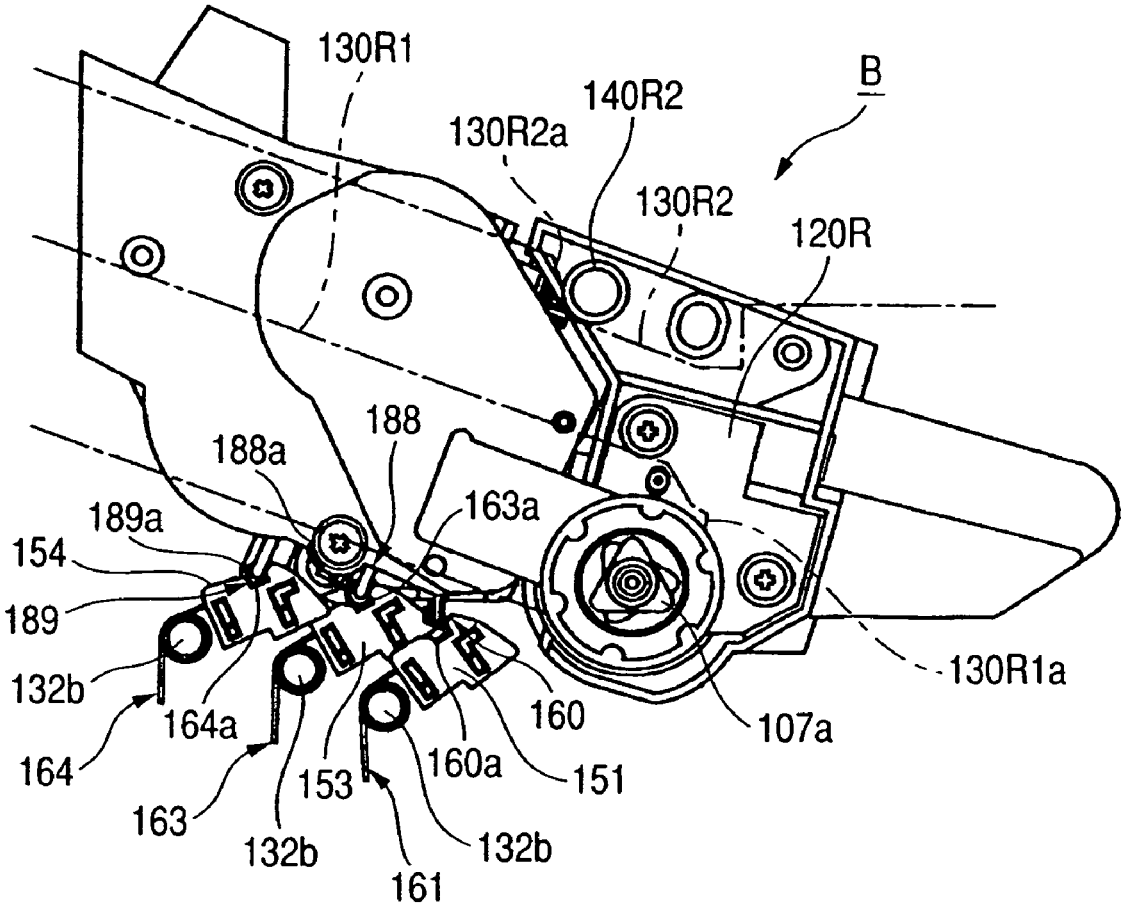
FIG. 14 is a side view of the interior of the apparatus main body for illustrating the process cartridge mounting operation in an image forming apparatus according to an embodiment of the present invention.

Reference is now had also to FIGS. 12 to 14 to further describe the movement of the contact cover 151 during the mounting of the cartridge B onto the apparatus main body A. FIG. 12 is a side view showing the movement locus of the cartridge contact member 160 and the movement loci of the contact cover 151 and the main body contact member 161 during the mounting of the cartridge B onto the apparatus main body A. In FIG. 12, the cartridge contact member 160 is shown typically as a circular side. Also, FIG. 13 is a side view of the interior of the apparatus main body A in the course of the mounting of the cartridge B onto the apparatus main body A. Also, FIG. 14 is a side view of the interior of the apparatus main body A with the cartridge B mounted on the apparatus main body A.

During the mounting of the cartridge B onto the apparatus main body A, the cartridge B is moved in the direction of arrow X along the aforedescribed cartridge mounting means 130 by the operator's mounting operation (FIG. 13).

As indicated by dots-and-dash line in FIG. 12, the cartridge contact member 160 strikes against the first guide portion 151*b*1 provided at the entrance of the cut-away portion 151*a*. While in FIG. 12, it strikes against the first guide portion 151*b*1, it strikes against second guide 151*b*2 in some cases. As described above, in the present embodiment, the cartridge contact member 160 abuts against the guide portions 151*b*1 and 151*b*2 as receiving portions. In operative association with the mounting operation of the cartridge B, the guide portions 151*b*1 and 151*b*2 have the function as cartridge abutting portions for moving the contact cover 151.

Then, the cartridge B is further inserted. Thereby, as indicated by dot-and-dash line in FIG. 2, the cartridge contact member 160 moves the contact cover 151. That is, the first guide portion 151*b*1 and the second guide portion 151*b*2 become thinner forwardly toward the exposed portion 151*a*1. Thus, in accordance with the movement of the cartridge contact member 160, the contact cover 151 is moved as indicated by arrow T1. In FIG. 12, the contact cover 151 is moved in a forward direction with respect to the mounting direction X of the cartridge B. Thus, the alignment of the contact cover 151 with the main body contact member 161 is roughly effected.

By the cartridge B being further inserted, the mounting guide members 140R1, 140R2, 140L1 and 140L2 of the cartridge B are positioned relative to the cartridge mounting means 130. During the time until the positioning, the cartridge contact member 160 further moves the contact cover 151 as indicated by arrow T2. As indicated by solid line in FIG. 12, the cartridge contact member 160 then fits into the cut-away portion 151*a*. Thereby, the contact cover 151 is positioned at a predetermined position. At that time, the main body contact 151*a* which is a portion exposed from the exposed portion 151*a*1 of the contact cover 151 and the contact portion (cartridge contact) 160*a* of the cartridge contact member 160 contact with each other. Thereby, the image forming apparatus 100 becomes capable of forming an image (FIG. 14). As described above, in the present embodiment, when the cartridge B is being mounted on the apparatus main body A, the cartridge contact member 160 abuts against the contact cover 151. Thereby, the cartridge contact member has the function as electrical contact cover member positioning means for regulating the position of the contact cover 151.

Also, in the present embodiment, the main body contact member 161 is formed by a torsion coil spring. In the present embodiment, this torsion coil spring is designed to flex in the mounting direction X of the cartridge B. Therefore, in a state in which the cartridge B is mounted on the apparatus main body A, the spring is brought down in the direction of arrow U (FIG. 12). Thereby, the spring is compressed and the contact members contact with each other with predetermined contact pressure.

Also, when the cartridge B is to be taken out of the apparatus main body A, an operation opposite to what has been described above is performed.

In the foregoing, when the cartridge B is to be mounted on the apparatus main body A, the cartridge contact member 160 abuts against the first guide portion 151*b*1. It has been described that at that time, the contact cover 151 moves in the forward direction (T1, T2) with respect to the mounting direction X of the cartridge B. However, this is not restrictive. In some cases, conversely the cartridge contact member 160 abuts against the second guide portion 151*b*2 in conformity with the position or the like of the contact cover 151 relative to the main body contact member 161 when the cartridge B is mounted. Further, there is also a case where the contact cover 151 moves in a direction opposite to the mounting direction X of the cartridge B. In the present embodiment, in a state in which the cartridge B is not mounted on the apparatus main body A, the contact cover 151 is lowered downwardly by gravity. Further, the tip end 151*h* of the contact member abuts against the bumping portion 151*g*. When the cartridge B is then mounted on the apparatus main body A, the contact cover 151 is moved in the forward direction with respect to the mounting direction X of the cartridge B. Also, as previously described, the contact cover 151 is movable in the direction of arrow T relative to the main body contact member 161. Further, the main body contact 161*a* is movable in the direction of arrow V relative to the apparatus main body A. The direction of arrow V is substantially perpendicular to the direction of arrow T. Therefore, the exposed portion 151*a*1 is movable in the direction of arrow V and the direction of arrow T perpendicular thereto. Accordingly, the degree of freedom of the movement of the exposed portion 151*a*1 can be secured by an inexpensive construction. Consequently, the reliability of the electrical connection between the main body contact 161*a* and the cartridge contact 160*a* can be improved.

With regard also to the other main body electrical contacts, i.e., the first main body remaining amount detecting contact member 163 and the second main body remaining amount detecting contact member 164, the constructions and operations of the contact covers 153, 154 and the main body contact members 163, 164 are similar to those of the developing output contact member 151 and the contact cover 151 thereof.

Also, in the present invention, description has been made of a case where the contact covers 151, 153 and 154 are provided particularly for the developing output contact 161, the first main body remaining amount detecting contact 163 and the second main body remaining amount detecting contact 164, respectively. Of course, however, a similar construction can also be applied to the charging output electrical contact member 144 in conformity with the mode of disposition or the like of the charging output electrical contact member 144, whereby the reliability of the electrical connection between the electrical contacts of the apparatus main body A and the electrical contacts of the cartridge B can be further improved.

{6. Circuit Board EC (Electric Circuit E)}

Here, a charging bias circuit E1 generates a negative DC voltage and an AC voltage. A voltage comprising the above-mentioned voltages superimposed one upon the other is then applied to the charging roller 108. The charging roller 108 receives this voltage and charges the photosensitive drum 107. The charging bias circuit E1 applies a negative DC voltage also to the fixing roller 105*b* through the drive roller 105*c*.

Also, a developing bias circuit E2 generates a negative DC voltage and an AC voltage. A voltage comprising the aforementioned voltages superimposed one upon the other is then applied to the developing roller 110 and the second detecting electrode 191. The developing roller 110 receives this voltage and develops the electrostatic latent image by a developer.

Also, a transferring bias circuit E3 generates a positive or negative DC voltage. Then, it applies the positive or negative DC voltage to the transfer roller 104.

Further, the first detecting electrode 190 is connected to the detecting circuit of a developer remaining amount detecting circuit E4, and an output voltage (developer amount detection voltage) when a voltage has been applied to the second detecting electrode 191 and the developing roller 110 is inputted thereto. Also, a reference voltage generating circuit generates a reference voltage in detecting the remaining amount of the developer, by the use of a current applied from the developing bias circuit E2. Then, the detecting circuit outputs the difference between the reference voltage and the developer amount detection voltage as the detected value of the remaining amount of the developer to a CPU. The information of the thus detected remaining amount of the developer is reported to the use by a display portion (not shown) or the like provided on the image forming apparatus main body A.

As described above, a voltage from a voltage source S is supplied to the charging roller 108 through the charging bias circuit E1. Also, the voltage from the voltage source S is supplied to the fixing roller 105*b* and the drive roller 105*c* through the charging bias circuit E1. Further, the voltage from the voltage source S is supplied to the developing roller 110 and the second detecting electrode 191 through the developing bias circuit E2. Also, the voltage from the voltage source S is supplied to the transfer roller 104 through the transfer charging bias circuit E3.

Figure 15:
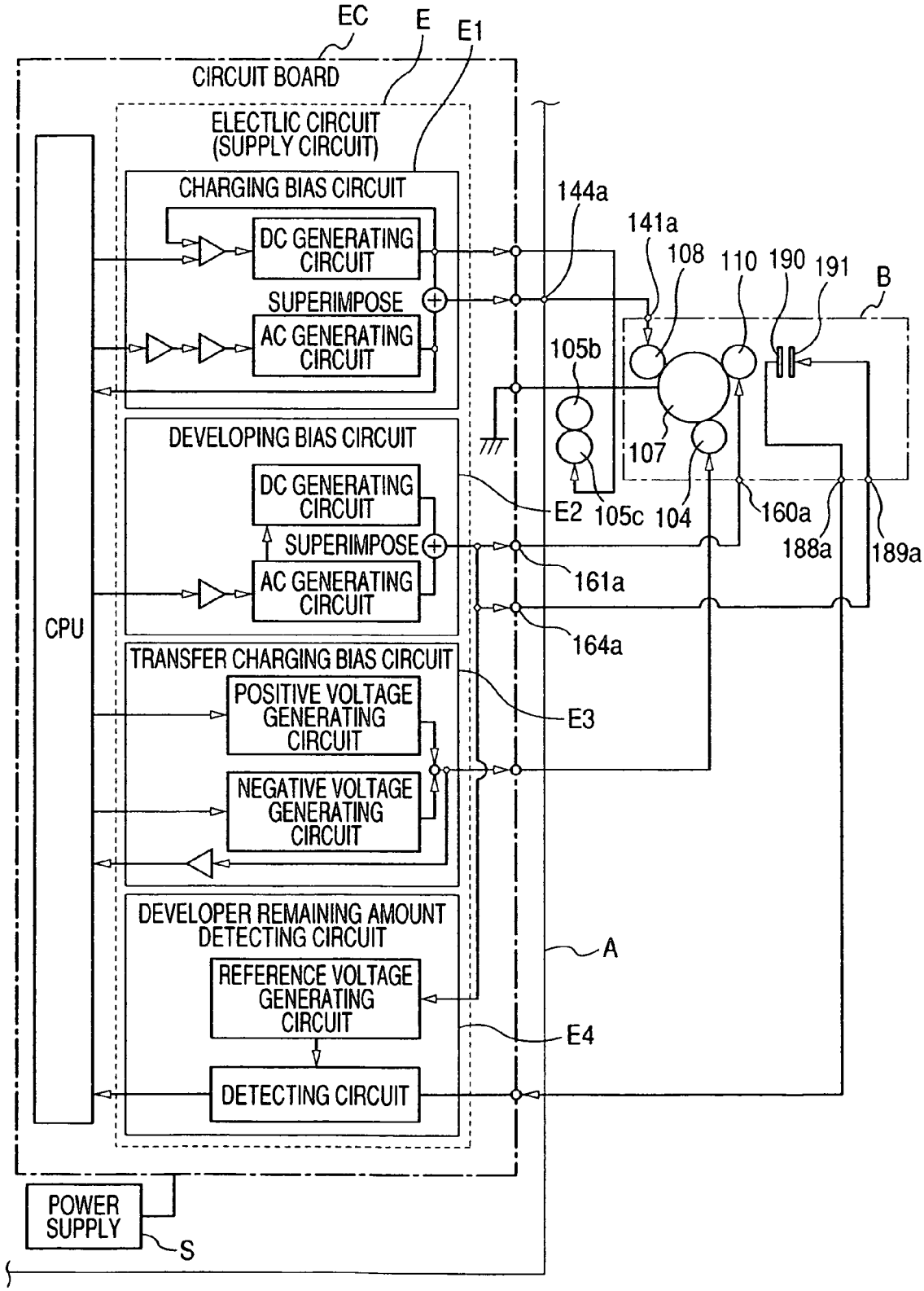
FIG. 15 is a view for illustrating the construction of the engine controller circuit board of an image forming apparatus according to an embodiment of the present invention.

These circuits E1, E2 and E3 have their ON and OFF controlled by instructions from a CPC 200 provided on a circuit board EC. The circuit board EC mounted on the apparatus main body A will now be described with reference to FIG. 15. This circuit board EC is mounted below the cartridge mounting portion 130*a*. The circuit board EC has the CPU 200 and an electric circuit E (power supply circuit) E.

Also, the voltage source S is connected to the circuit board EC, i.e., the electric circuit E. The electric circuit E is comprised of the charging bias circuit E1, the developing bias circuit E2, the transfer charging bias circuit E3 and the developer remaining amount detecting circuit E4.

The charging bias circuit E1 generates a negative DC voltage and an AC voltage. It applies to the charging roller 108 a voltage comprising the aforementioned voltages superimposed one upon the other. The charging roller 108 receives this voltage and charges the photosensitive drum 107. The charging bias circuit E1 also applies the negative DC voltage to the fixing roller 105*b* through the drive roller 105*c*.

Also, the developing bias circuit E2 generates a negative DC voltage and an AC voltage. It applies to the developing roller 110 and the second detecting electrode a voltage comprising the aforementioned voltages superimposed one upon the other. The developing roller 110 receives this voltage and develops the electrostatic latent image by the developer.

Also, the transferring bias circuit E3 generates a positive or negative DC voltage. It appears the positive or negative DC voltage to the transfer roller 104. Further, the first detecting electrode 190 is connected to the detecting circuit of the developer remaining amount detecting circuit E4, and an output voltage (developer amount detection voltage) when a voltage has been applied to the second detecting electrode 191 and the developing roller 110 is inputted. Also, the reference voltage generating circuit generates a reference voltage in detecting the remaining amount of the developer, by the use of a current applied from the developing bias circuit E2. Then, the detecting circuit outputs the difference between the reference voltage and the developer amount detection voltage as the detected value of the remaining amount of the developer to the CPU. The thus detected information of the remaining amount of the developer is reported to the use by a display portion (not shown) or the like provided in the image forming apparatus main body A.

As described above, the voltage from the voltage source S is supplied to the charging roller 108 through the charging bias circuit E1. Also, the voltage from the voltage source S is supplied to the fixing roller 105*b* and the drive roller 105*c* through the charging bias circuit E1. Further, the voltage from the voltage source S is supplied to the developing roller 110 and the second detecting electrode 191 through the developing bias circuit E2. Also, the voltage from the voltage source S is supplied to the transfer roller 104 through the transfer charging bias circuit E3.

These circuits have their ON and OFF controlled by the instructions from the CPU 200 provided on the circuit board EC.

Thus, in the present embodiment, the following effects can be achieved.

(1) The contact covers 151, 153 and 154 are mounted for movement relative to the main body contact members 161, 163 and 164 provided with the main body contacts 161*a*, 163*a* and 164*a* electrically connected to the cartridge contacts 160*a*, 188*a* and 189*a* the cartridge has, and these contact covers 151, 153 and 154 are designed to move in operative association with the mounting operation of the cartridge B.

Thus, even when a foreign substance has come into the apparatus main body A such as when with the cartridge B taken out of the apparatus main body A, the operator inserts his hand to perform the mounting of the cartridge B, maintenance or jam treatment or the like, the apparatus main body contact members 161, 163 and 164 are protected by the contact covers and therefore, the operator cannot easily touch the main body contact members 161, 163 and 164 are protected by the contact covers and therefore, the operator cannot easily touch the main body contacts 161*a*, 163*a* and 164*a*. Therefore, it can be suppressed for a foreign substance (such as the developer or grease adhering to the operator's hand, or man's sweat or fat) to adhere to the electrical contacts of the apparatus main body A to thereby cause faulty conduction.

When the cartridge B is to be mounted on the apparatus main body A, the contact covers 151, 153 and 154 move in operative association with the mounting operation of the cartridge B. Thereby, the main body contacts 161*a*, 163*a*, 164*a* and the cartridge contacts 160*a*, 188*a*, 189*a* are electrically connected together. Consequently, the operator can very simply connect the main body contacts 161*a*, 163*a*, 164*a* and the cartridge contacts 160*a*, 188*a*, 189*a* together without performing any special operation.

Accordingly, the reliability of the electrical connection between the electrical contacts provided in the apparatus main body A and the electrical contacts provided in the cartridge B can be improved.

(2) The contact covers 151, 153 and 154 are proved with the cut-away portion 151*a* capable of effecting the condition of the contacts. Therefore, as compared with a shape in which the contact portion 151*a* is completely covered, the amounts of movement of the contact covers 151, 153 and 154 can be made small. Accordingly, the space occupied by the contact covers 151, 153 and 154 can be minimized. As the result, the image forming apparatus 100 can be made compact.

(3) Also, the cartridge contact members 160, 188 and 189 are made to abut against the guide portions 151*b*1 and 151*b*2 of the contact cover 151 as cartridge abutting portions. Thereby, the contact cover 151 is moved. Accordingly, it is possible to move the contact covers 151, 153 and 153 without adding any special part for the movement of the contact covers 151, 153 and 154. Also, the cartridge contact members 160, 188 and 189 fit into the cut-away portion 151*a* to thereby effect the positioning of the contact covers 151, 153 and 154. Thereby, it is possible to align the contact covers with the contacts of the cartridge B highly accurately without adding any special part for the positioning of the contact covers 151, 153 and 154. Accordingly, a contact protecting mechanism of high quality can be realized at a low cost.

Further, the inner side of the cut-away portion 151*a* (an opening portion continuous to the exposed portion 151*a*) provided on the contact covers 151, 153 and 154 are made into guide portions 151*b*1 and 151*b*2 (receiving portions). Thereby, in the operation of mounting the cartridge B on the apparatus main body A, the movement of the electrical contact cover members 151, 153 and 154, the connection of the electrical contacts and the positioning of the contact covers 151, 153 and 154 are effected in a series. Therefore, the mechanism is simple and high in reliability.

(4) The direction of movement (directions T1 and T2) of the contact cover relative to the apparatus main body A is substantially the same direction as the mounting direction (X direction) of the cartridge B. Therefore, it is possible to cope with even a case where the positions of the cartridge contact members 160, 188 and 189 fluctuate due to the unevenness of the parts of the cartridge B or the backlash thereof during the mounting. It is possible to align the contact covers 151, 153 and 154 with the electrical contacts of the cartridge B highly accurately. Accordingly, a contact protecting mechanism of high quality can be realized.

(5) In a case where the apparatus main body A has a plurality of contact members, by adopting a construction in which contact covers are individually disposed, it is possible to downsize the contact covers 151, 153 and 154 themselves, as compared with a case where a plurality of contact members are covered with a single contact cover. At the same time, the downsizing of the image forming apparatus 100 also becomes possible. Also, by adopting such a construction, the degree of freedom of the disposition of each contact member is high and it is possible to individually cope with the positional deviation of the contact members. Accordingly, the downsizing of the image forming apparatus is possible and a contact protecting mechanism of high quality can be realized.

(6) In the present embodiment, the respective electric power supplied members (the charging member, the developing member and the developer amount detecting member) are electrically connected to the respective cartridge electrical contacts (160*a*, 188*a* and 189*a*) in the interior of the process cartridge B as a cartridge.

(7) In the present embodiment, description has been made by the use of a process cartridge having an electrophotographic photosensitive member and process means integrally with each other. The present invention, however, is also applicable to a charging unit having a charging member for charging an electrophotographic photosensitive member, and having no electrophotographic photosensitive member. Likewise, the present invention is also applicable to a developing unit having a developing member for developing an electrostatic latent image formed on an electrophotographic photosensitive member, and having no electrophotographic photosensitive member. Here, the electrophotographic photosensitive member mountable to the apparatus main body. Or it is mounted on the apparatus main body.

According to the present invention, the reliability of the electrical connection between the electrical contacts the process cartridge has and the electrical contacts provided in the electrophotographic image forming apparatus main body can be improved.

Also, according to the present invention, it is difficult for stains to adhere to the main body electrical contacts.

Also, according to the present invention, there can be provided an electrophotographic image forming apparatus and a cartridge or a process cartridge in which in operative association with the operation of mounting the cartridge on the electrophotographic image forming apparatus main body, electrical contact cover members are moved relative to main body electrical contact members, whereby cartridge electrical contacts and main body electrical contacts are electrically connected together.

While the invention has been described with reference to the structure disclosed herein, it is not confined to the details set forth and this application is intended to cover such modifications or changes as may come within the purposes of the improvements or the scope of the following claims.

What is claimed is:

1. A cartridge detachably mountable to an electrophotographic image forming apparatus main body, the electrophotographic image forming apparatus main body including a movable main body electrical contact member having a main body electrical contact, and an electrical contact cover member having an exposed portion to expose the main body electrical contact and a receiving portion to receiving a force, the electrical contact cover member being movable relative to the main body electrical contact member and attached to the main body electrical contact member to cover the main body electrical contact member, said cartridge comprising:

an electric power supplied member; and a cartridge electrical contact member electrically connected to said electric power supplied member, said cartridge electrical contact member abutting against the receiving portion in order to move the electrical contact cover member to a position for contacting the main body electrical contact with said cartridge electrical contact member at the exposed portion in operative association with an operation of mounting said cartridge on the electrophotographic image forming apparatus main body, and said cartridge electrical contact member being electrically connected to the main body electrical contact to supply electric power to said electric power supplied member when said cartridge is mounted on the electrophotographic image forming apparatus main body.

2. A cartridge according to claim 1, wherein said cartridge electrical contact member comprises:

a cartridge electrical contact electrically connectable to the main body electrical contact; and an abutting portion to abut against the receiving portion.

3. A cartridge according to claim 2, wherein said cartridge electrical contact member has a regulating portion to regulate a position of the electrical contact cover member when said cartridge is mounted on the electrophotographic image forming apparatus main body.

4. A cartridge according to claim 1, wherein said cartridge electrical contact member is electrically conductive.

5. A cartridge according to claim 1, wherein said electric power supplied member is:

a developing member configured and positioned to develop an electrostatic latent image formed on an electrophotographic photosensitive member;

a charging member configured and positioned to charge the electrophotographic photosensitive member; or a developer amount detecting member of said cartridge, wherein said cartridge electrical contact is a developing bias contact configured and positioned to receive from the main body electrical contact a developing bias to be applied to the developing member when said electric power supplied member is said developing member;

wherein said cartridge electrical contact is a charging bias contact configured and positioned to receive from the main body electrical contact a charging bias to be applied to said charging member when said electric power supplied member is said charging member; or wherein said cartridge electrical contact is a remaining amount detecting contact configured and positioned to receive from the main body electrical contact a voltage to be applied to said developer amount detecting member of said cartridge when said electric power supplied member is said developer amount detecting member, or transmitting a detection signal from said developer amount detecting member to the apparatus main body through the main body electrical contact.

6. A cartridge according to claim 1, wherein said electric power supplied member is a charging member configured and positioned to charge an electrophotographic photosensitive member, and said cartridge electrical contact receives from the main body electrical contact a voltage for charging the electrophotographic photosensitive member; or wherein said electric power supplied member is a developing member configured and positioned to develop an electrostatic latent image formed on the electrophotographic photosensitive member, and said cartridge electrical contact receives from the main body electrical contact a voltage for developing the electrostatic latent image; or wherein said electric power supplied member is a developer amount detecting member configured and positioned to detect a developer amount contained in a developer containing portion, and said cartridge electrical contact receives from the main body electrical contact a voltage for detecting the developer amount.

7. A cartridge according to claim 1, wherein said cartridge is a charging unit having a charging member configured and positioned to charge an electrophotographic photosensitive member, or a developing unit having a developing member configured and positioned to develop an electrostatic latent image formed on an electrophotographic photosensitive member.

* * * * *

UNITED STATES PATENT AND TRADEMARK OFFICE

CERTIFICATE OF CORRECTION

PATENT NO. : 7,200,347 B2
APPLICATION NO. : 11/407153
DATED : April 3, 2007
INVENTOR(S) : Akiyoshi Yokoi et al.

It is certified that error appears in the above-identified patent and that said Letters Patent is hereby corrected as shown below:

COLUMN 8:
Line 21, "apportion" should read --a portion--.

COLUMN 19:
Line 64, "mountable" should read --is mountable--.

Signed and Sealed this

Twenty-ninth Day of July, 2008

JON W. DUDAS
*Director of the United States Patent and Trademark Office*